US006477321B2

(12) United States Patent
Reiker

(10) Patent No.: US 6,477,321 B2
(45) **Date of Patent: *Nov. 5, 2002**

(54) CEILING FAN ROOM CONDITIONER WITH CEILING FAN AND HEATER

(76) Inventor: Kenneth H. Reiker, 269 Country Club Dr., Shalimar, FL (US) 32579

( * ) Notice: Subject to any disclaimer, the term of this patent is extended or adjusted under 35 U.S.C. 154(b) by 0 days.

This patent is subject to a terminal disclaimer.

(21) Appl. No.: 09/805,478

(22) Filed: Mar. 13, 2001

(65) Prior Publication Data

US 2002/0021891 A1 Feb. 21, 2002

Related U.S. Application Data

(63) Continuation of application No. 09/443,617, filed on Nov. 19, 1999, now Pat. No. 6,240,247, which is a continuation-in-part of application No. 09/439,763, filed on Nov. 15, 1999.

(60) Provisional application No. 60/109,163, filed on Nov. 20, 1998.

(51) Int. Cl.[7] ..... F24H 3/00

(52) U.S. Cl. ..... 392/364; 416/5

(58) Field of Search ..... 392/360–369, 392/384–385; 416/5, 95, 120; 165/122, 125, 59

(56) References Cited

U.S. PATENT DOCUMENTS

| | | | | |
|---|---|---|---|---|
| 449,404 | A | 3/1891 | Dewey | |
| 2,359,021 | A | 9/1944 | Campbell et al. | |
| 2,504,798 | A | 4/1950 | Brinen | |
| 3,223,828 | A | 12/1965 | Mast | |
| 3,458,739 | A | 7/1969 | Zelinski et al. | |
| 3,612,168 | A | 10/1971 | Peterson | 165/86 |
| 4,508,958 | A | 4/1985 | Kan et al. | |
| 4,694,142 | A | 9/1987 | Glucksman | |
| 4,782,213 | A | 11/1988 | Teal | |
| D320,439 | S | 10/1991 | Harper | |
| 5,077,825 | A | 12/1991 | Monrose | |
| D327,315 | S | 6/1992 | Pelonis | D23/355 |
| 5,133,042 | A | 7/1992 | Pelonis | 392/365 |
| 5,259,062 | A | 11/1993 | Pelonis | 392/365 |
| 5,333,235 | A | 7/1994 | Ryder | 392/364 |
| D358,873 | S | 5/1995 | Pelonis | D23/337 |

(List continued on next page.)

FOREIGN PATENT DOCUMENTS

| | | |
|---|---|---|
| DE | 3814612 | 11/1989 |
| GB | 865167 | 11/1958 |
| JP | 401123949 A | 5/1989 |
| WO | WO 01/01047 A1 | 1/2001 |

OTHER PUBLICATIONS

"The Fan Book" published by Reston Publishing Company, pp. 3–128, copyright 1983.
Internet Web Page entitled "Pelonis U.S.A." , Pelonis USA, LTD., 2000, 7 pages.

*Primary Examiner*—John A. Jeffery
(74) *Attorney, Agent, or Firm*—Joel D. Myers; Myers & Kaplan, L.L.C.

(57) ABSTRACT

A room conditioner provides an essentially uniform temperature within a room upon operation of a motor of a ceiling fan. The motor includes a stator supporting by a ceiling mounted shaft and a rotor supporting a set of fan blades of the ceiling fan for causing airflow upon energization of the motor. A heating element supported by the shaft and upwardly displaced from the ceiling fan heats air flowing therepast and a secondary fan responsive to the rotor via a sleeve about the shaft draws air past the heating element. Heated air flowing from the heating element is mixed with the airflow caused by operation of the set of fan blades to distribute warmed air uniformly throughout the space of the room wherein the room conditioner is located.

37 Claims, 17 Drawing Sheets

U.S. PATENT DOCUMENTS

| | | | | |
|---|---|---|---|---|
| 5,425,126 | A | | 6/1995 | Lee ..... 392/364 |
| 5,489,191 | A | | 2/1996 | Tai |
| D381,074 | S | | 7/1997 | Pelonis ..... D23/336 |
| 5,668,920 | A | | 9/1997 | Pelonis ..... 392/361 |
| D404,123 | S | | 1/1999 | Pelonis ..... D23/336 |
| 5,887,785 | A | | 3/1999 | Yilmaz |
| D423,661 | S | | 4/2000 | Pelonis ..... D23/395 |
| 6,160,956 | A | | 12/2000 | Pelonis ..... 392/361 |
| 6,240,247 | B1 | * | 5/2001 | Reiker ..... 392/364 |
| 6,244,820 | B1 | | 6/2001 | Yilmaz |

* cited by examiner

CEILING FAN ROOM CONDITIONER WITH CEILING FAN AND HEATER

CROSS REFERENCE TO RELATED APPLICATIONS

The present application is a continuation application of a patent application entitled "CEILING FAN WITH ATTACHED HEATER AND SECONDARY FAN" filed in Nov. 19, 1999 and assigned Ser. No. 09/443,617, now U.S. Pat. No. 6,240,247 which application is a continuation-in-part application of a patent application entitled "CEILING FAN WITH ATTACHED HEATER AND SECONDARY FAN" filed Nov. 15, 1999, and assigned Ser. No. 09/439,763 and discloses information common with a provisional application entitled "CEILING FAN WITH CEILING MOUNTED HEATER" filed Nov. 20, 1998 and assigned Serial No. 60/109,163.

BACKGROUND OF THE INVENTION

1. Field of the Invention

The present invention relates to room conditioners and, more particularly, to ceiling mounted heaters embodied with a ceiling fan for injecting heated air into the airflow generated by the ceiling fan to uniformly maintain a room at a constant comfortable temperature.

2. Description of Related Art

In present forced air heating systems, whether in an office environment or in a residence, a heating element is energized by burning gas, burning coal or electricity. A blower is employed for blowing air across the heating element to force the heated air into a duct system. Entry of the heated air into the duct system generally requires a change in direction of the blown heated air, which change or direction creates resistance to airflow. To channel the heated air through multiple changes of direction within the duct system until it is finally exhausted into respective rooms creates further resistance to the airflow. Louvers, whether fixed or movable, generally cover the duct system outlets in each room. Such louvers further alter the direction of airflow and create resistance to the airflow. The collective sum of resistances to airflow presented by a conventional forced air system requires a blower of significant power to ultimately provide a reasonable flow of air into each room through a louvered outlet.

The louvered outlets may be close to the floor, close to the ceiling or anywhere in between depending upon various construction requirements and other impediments. The outflow of heated air through an outlet close to the floor will create adjacent hot spots for an occupant that renders seating close to the louvered outlet uncomfortable. Heated airflow through a louvered outlet close to the ceiling tends to restrict disbursement of the heated air throughout the room as heated air rises and tends to remain in proximity with the ceiling; thus, there may exists cold spots in parts of the room close to the floor. Finally, certain parts of a room be subjected to a downward blast of hot air that is uncomfortable and limits furniture arrangement to prevent a person from being subjected to such a blast.

Conventional duct work is generally of galvanized sheet material which is an excellent thermal conductor. The duct work will therefore tend to become heated and radiate heat into the adjacent attic or walls. Such radiated heat is lost to the occupants of a residence or office and the heater must have an output of sufficient BTU's (British thermal units) to compensate for these heat losses and yet provide sufficient heat to the rooms of interest.

The change in temperature of the duct work may result in condensation developing on the surface of the duct work and adjacent the louvers at the outlets. Such condensation may flow and seep into the material of the walls of a room and cause discoloration.

If certain rooms or offices are unoccupied, it is bothersome to prevent the heating thereof as the respective louvers must be closed and thereafter reopened. Such closing and reopening is generally considered too bothersome to be done unless the respective room is to be closed for a significant period of time. Thus, rooms which are not occupied will remain heated to the detriment of unnecessary energy usage and expense.

It therefore becomes evident that presently widely used forced air heating systems require large capacity heaters to overcome the thermal losses incurred during delivery of the heated air to each room. Large capacity blowers are required to overcome the flow restrictions presented by the duct system and outlet louvers. The energy consumption resulting from such heaters and blowers without any benefit to the occupants of a residence or office is significant and expensive. Blasts of hot air and poor mixing of the heated air with the ambient air in the space to be heated creates discomfort to the occupants.

SUMMARY OF THE INVENTION

The present invention is directed to a room conditioner for heating and gently recirculating air in a room to maintain the air throughout the room at a pleasant uniform temperature without drafts or blasts of heated air. The room conditioner has a heating element mounted proximate the ceiling above the motor of a ceiling fan to heat the air flowing therepast. A secondary fan located adjacent the heating element and operated in response to rotation of the rotor of the ceiling fan, draws air past the heating element and exhausts the resulting heated air. The heated air is mixed with the airflow caused by operation of the set of fan blades of the ceiling fan. The ceiling fan and the secondary fan may direct the airflow upwardly or downwardly. The resulting warmed air circulates gently throughout the room to warm the room to a temperature comfortable for a user. All of the heat produced by the heating element is essentially conveyed throughout the room at significant energy cost savings compared to a forced air heating system. When the room is not being used, the ceiling fan and heating element may be turned off to conserve on electrical energy resulting in an attendant cost savings.

It is therefore a primary object of the present invention to provide a room conditioner for efficiently heating and maintaining a room at a temperature comfortable to a user.

Another object of the present invention is to provide energy efficient apparatus for selectively heating a room being used.

Still another object of the present invention is to provide a room conditioner producing high volume low velocity heated air circulating throughout a room.

Yet another object of the present invention is provide a room conditioner embodying a ceiling fan and an associated heating element, which heating element will not increase the operating temperature of the ceiling fan motor.

A further object of the present invention is to provide a room conditioner embodying a motor for rotating the set of blades of a ceiling fan and a secondary fan for drawing air past a heating element to mix the heated air with the surrounding airflow produced by the set of blades of the ceiling fan.

A still further object of the present invention is to provide a room conditioner capable of introducing a flow of heated air with a heater and for cooling a room when the heater is not energized.

A yet further object of the present invention is to provide a method for uniformly and efficiently heating a room.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
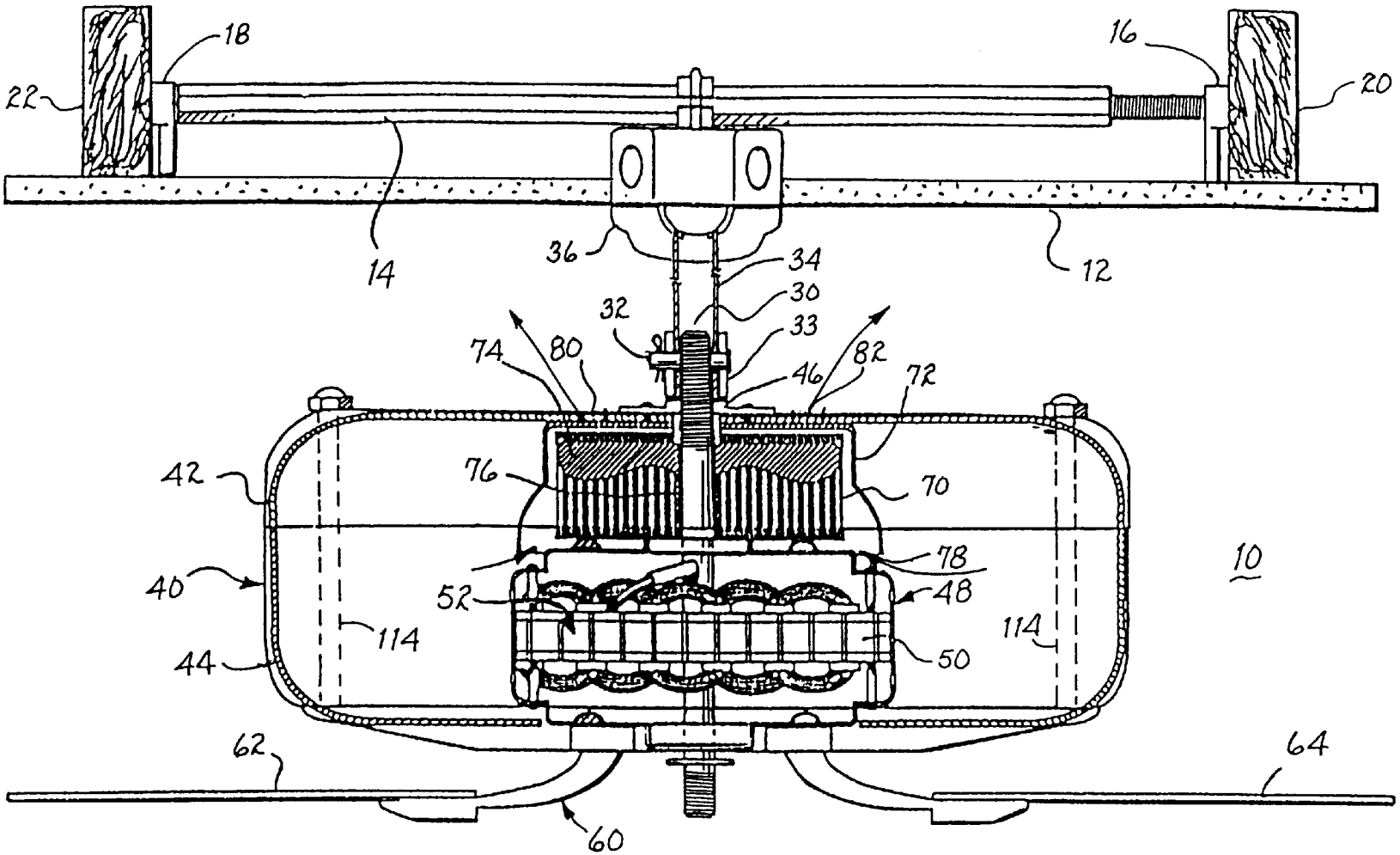
FIG. 1 is a representative cross-sectional view of a room conditioner suspended from a brace mounted intermediate studs of a ceiling.

Referring to FIG. 1, there is illustrated in cross-section a room conditioner 10 suspended below a ceiling 12 from a brace 14 having opposed ends 16, 18 supported by studs 20, 22. The room conditioner includes a depending shaft 30 pinned by pin 32 through a fixture 33 to a sleeve 34 depending from a mounting 36 secured to brace 14. A housing 40, including an upper part 42 and lower part 44, is attached to a plate 46 in threaded engagement with the upper end of shaft 30. The material may also be thermally insulative to prevent heating of a surrounding enclosure to afford limitless selection of material for such enclosure. Moreover, housing 40 may be of electrically insulating material for safety reasons. Appropriate locking mechanism may be employed to prevent rotation of the housing relative to the shaft. A casing 48 is rotatably mounted upon shaft 30 and is secured to rotor 50 of electric motor 52. The stator (not shown) of the electric motor is fixedly attached to shaft 30. A set of fan blades 60, of which blades 62, 64 are shown, is fixedly attached to casing 48. Thereby, rotation of rotor 50 will result in rotation of the casing and consequent rotation of set of fan blades 60. A cylindrically configured heating element 70 is fixedly attached to upper housing 42 and is disposed within a depending shroud 72. A secondary fan 74 extends from a sleeve 76 rotatably mounted about shaft 30 and fixedly attached to casing 48. Thereby, rotation of casing 48 will produce commensurate rotation of fan 74. Rotation of fan 74 will draw air upwardly through the lower open end 78 of shroud 72 past heating element 70 and discharge the heated air through apertures 80 extending through the upper part of shroud 72 and upper housing 42. The exhausted heated air will mix with the upwardly flowing airflow produced by set of fan blades 60 and be dispersed in a temperature uniform manner throughout the space of the room within which room conditioner 10 is mounted.

Figure 2:
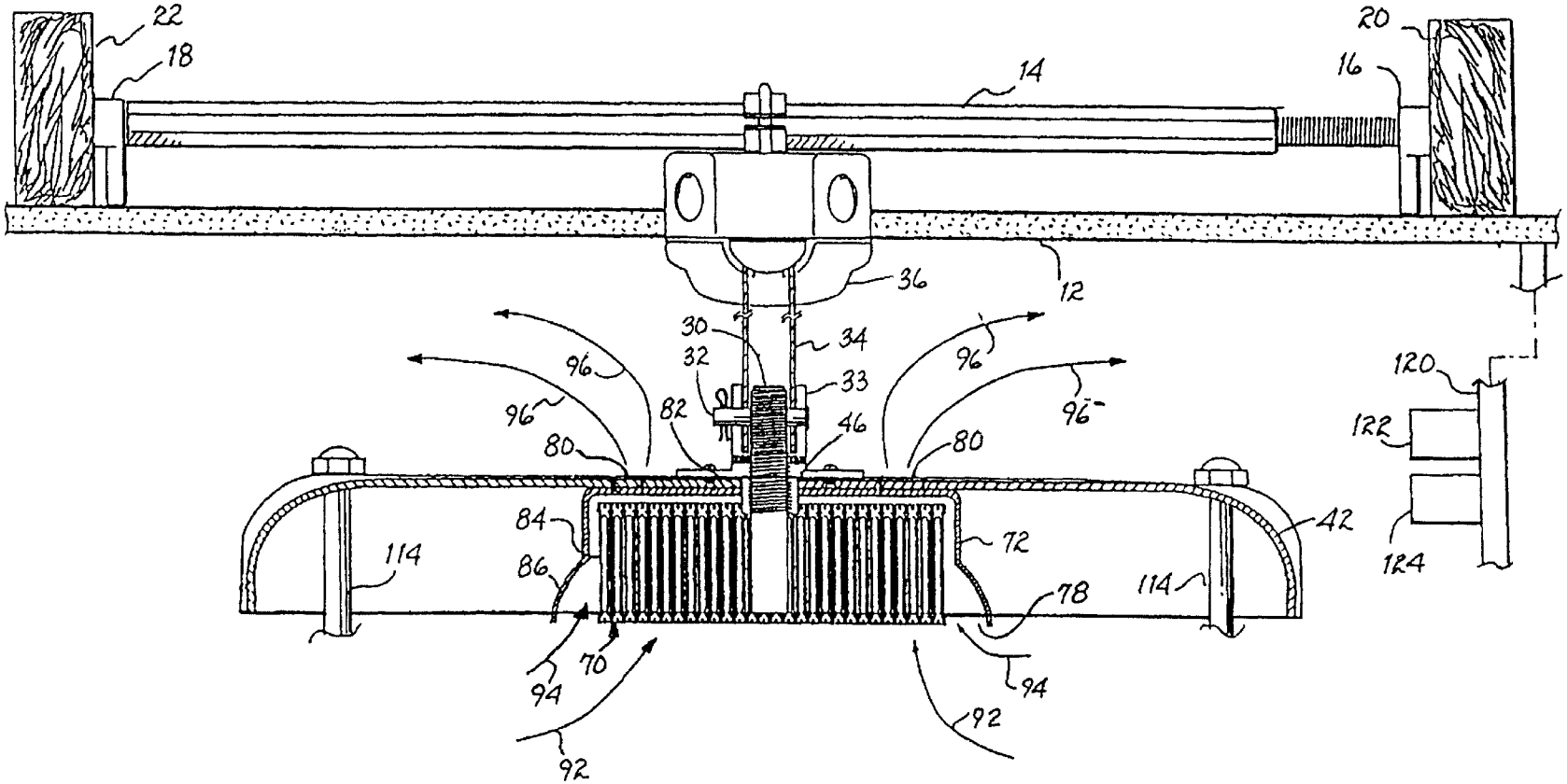
FIG. 2 is a cross-sectional view of the upper half of the room conditioner shown in FIG. 1.
Figure 3:
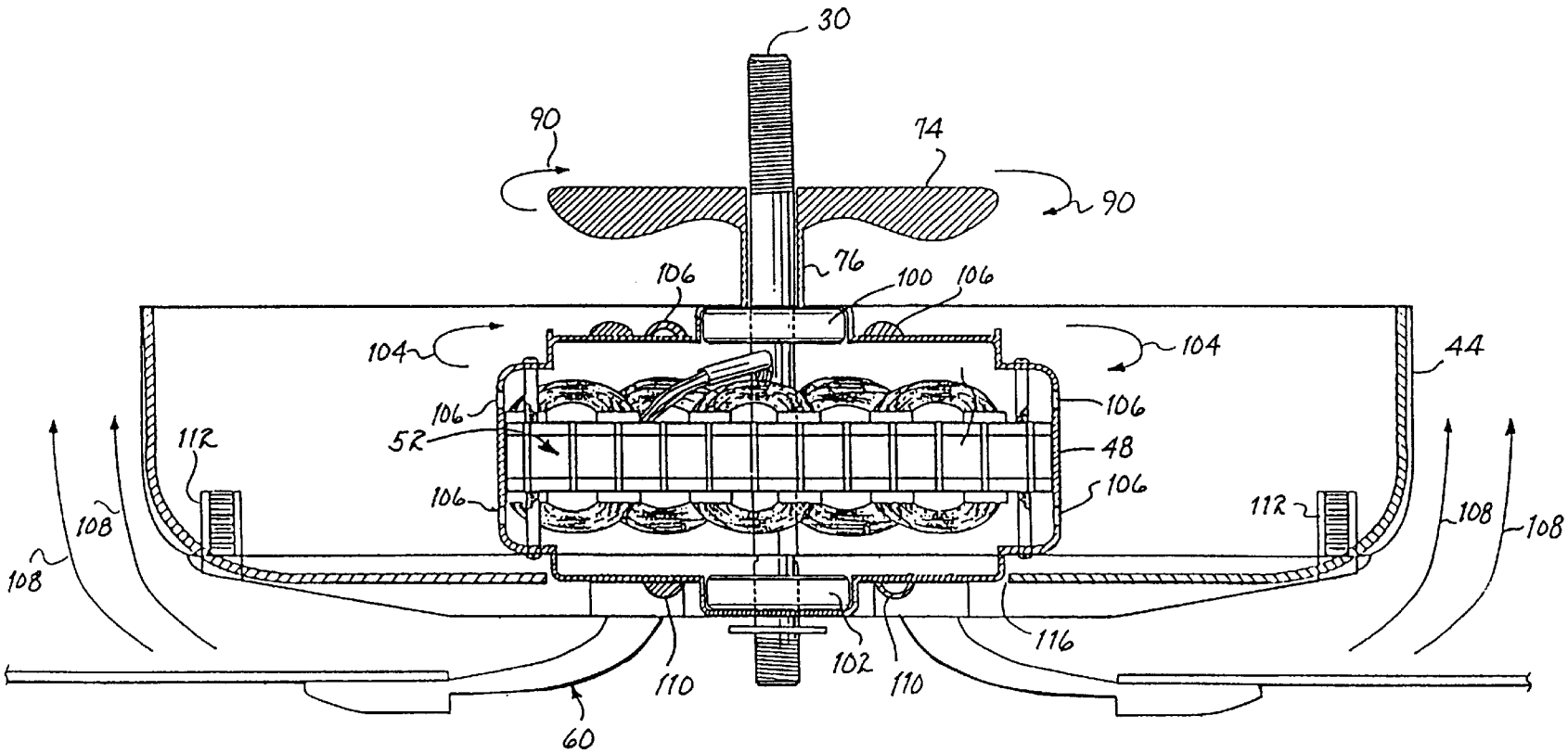
FIG. 3 is a cross-sectional view of the bottom half of the room conditioner shown in FIG. 1.

Referring jointly to FIGS. 2 and 3, further details of room conditioner 10 will be described. Heating element 70 is annular and includes cross-braces (not shown) disposed at the upper end and extending radially from a hub, which hub is fixedly attached to a threaded collar 82 in threaded engagement with shaft 30. Thereby, heating element 70 is concentrically mounted about the shaft. Cylindrical sidewall 84 of the heater includes a plurality of longitudinally extending heating elements responsive to a source of electricity (not shown) and spaced apart from one another to permit airflow through slots therebetween. Heating elements of this type are readily commercially available from various sources. Shroud 72 may include a radially expanded lower part 86 to enhance airflow thereinto. Secondary fan 74 is fixedly attached to casing 48 by sleeve 76 attached to and extending upwardly from the casing. Rotation of the fan, as depicted by arrows 90, will draw air into the interior of heating element 70, as depicted by arrows 92, and into the space intermediate shroud 72 and heating element 70, as depicted by arrows 94. As the air flows through slotted sidewall 84 and within the heating element, the air is subjected to conductive and radiant heat from the heating element and is thereby heated. The heated air exhausts through apertures 80, as depicted by arrows 96.

Casing 48, enclosing motor 52, is journaled upon shaft 30 by bearings 100 and 102 whereby the casing is freed to rotate about the shaft, as depicted by arrows 104. Preferably, all or part of casing 48 may be of thermally insulative material, including non-metallic and dielectric materials, to prevent migration of heat from heating element 70 to motor 52 and consequent damage to the motor. To assist in cooling motor 50, vents 106 may be disposed in the cylindrical segment of casing 48, as illustrated. Forced air cooling of motor 52 may be accomplished by incorporating scoops 110 at the bottom of casing 48 to capture air as casing 48 rotates and direct the captured air into the casing. Similar but reverse oriented scoops 106 are disposed in the top of casing 48 to encourage exhausting of the air. Thereby, a positive airflow through casing 48 for purposes of cooling motor 52 is accomplished whenever the casing rotates as a result of energization of the motor. The air exhausted from casing 48, being partially warmed, flows into to the interior of heating element 70 and will become further heated thereby.

Lower housing 44 may include a plurality of threaded studs 112 for threadedly receiving bolts 114 extending downwardly from upper housing 42. Through such threaded engagement, a means is provided for securing the upper and lower housings to one another. Set of blades 60 is attached to casing 48 in the conventional manner. The bottom surface of lower housing 44 may include an aperture 116 to permit protrusion of all or part of casing 48. Such aperture may be of sufficient diameter to provide an annular space between the perimeter of the aperture and casing 48 to permit a ready flow of air into the housing and to provide a ready source of air to be drawn into and through heating element 70 by fan 74. Alternatively, either or both the upper and lower housings may include apertures in the sidewalls thereof to provide sufficient airflow into the housing.

By having set of blades 60 rotate in a direction to direct air upwardly, as depicted by arrows 108, the upwardly flowing air will mix with the warmed air exhausted from the upper part of housing 40. The mixing of the ambient temperature airflow with the heated airflow will produce a resulting airflow throughout the room that is at a higher temperature than the initial ambient temperature. By employing a wall 120 mounted thermostat 122 (see FIG. 2) electrically connected (not shown) to the heating element, the temperature can be regulated. Moreover, a switch 124, which may be wall mounted, as shown, electrically connected (not shown) to motor 52 can permit control of the speed and direction of rotation of the motor and hence set of blades 60 and secondary fan 74. Thus, operation of the heating element may be regulated to maintain the air within the room at a temperature preferred by an occupant of the room. A time delay may also be incorporated in or as part of switch 124 to first shut off the heating element and then the motor and for other purposes. Furthermore, upon departure from the room, whether for a short period of time or an extended absence, room conditioner 10 may be shut down by switch 124 to conserve the use of electric power.

Figure 4:
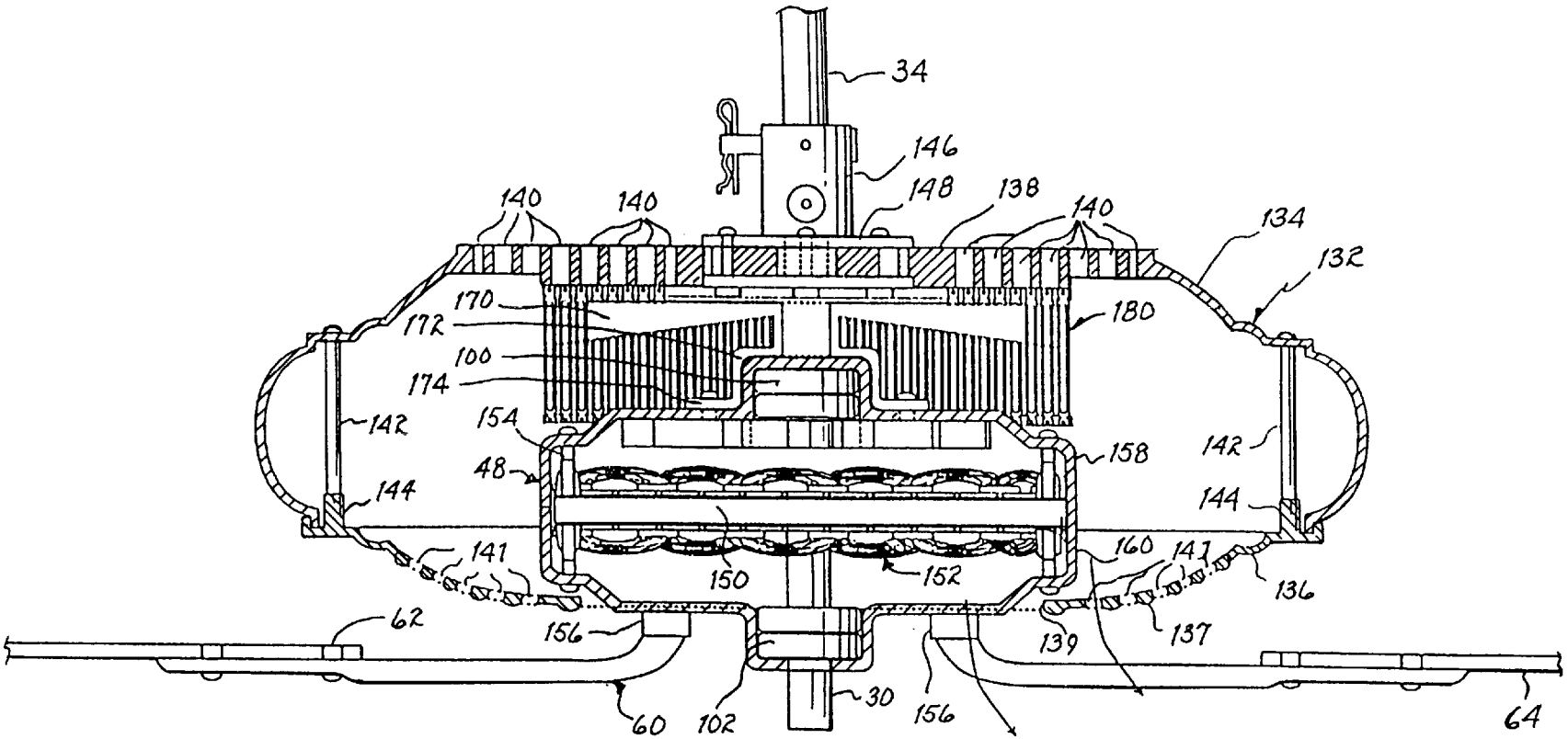
FIG. 4 illustrates a cross-sectional view of a room conditioner embodying the principles of the present invention.

FIG. 4 illustrates a variant 130 of basic room conditioner 10 described above. In particular, variant 130 is related to a commercially viable embodiment of the present invention. Variant 130 includes a housing 132 having an upper housing 134 and a lower housing 136. Lower housing 136 includes an inwardly extending section 137 defining a central opening by edge 139. The edge is radially displaced outwardly of adjacent casing 48 to provide an air passage therebetween. To enhance airflow into the interior of housing 132, section 137 may include a plurality of apertures 141, whether circular, elongated or other shape. The upper housing includes a concentric circular section 138 having a plurality of apertures 140 extending therethrough for purposes of ventilation. Bottom housing 136 is secured to upper housing through bolts 142 threadedly engaging studs 144. A fixture 146 is pinned to sleeve 34 dependingly secured proximate the ceiling of a room wherein room conditioner 130 is located.

Means, such as plate 148, is secured to fixture 146 and retains section 138 to support housing 132. Shaft 30, depending from fixture 146, rotatably supports casing 48 via bearings 100, 102; these may be single bearings or dual bearings, as illustrated. The casing may be attached to rotor 150 of motor 152 by bolts 154, which bolts also secure the upper and lower parts of the casing to one another. The stator of motor 152 is fixedly attached to shaft 130. Thereby, casing 48 will rotate upon energization of the electric motor. Set of fan blades 60, of which blades 62, 64 are shown, is attached to casing 148 through brackets 156, which brackets are of a conventional type. Thereby, set of blades 60 will rotate upon rotational movement of the rotor of electric motor 152.

Further details of variant 130 of a room conditioner will be described with joint reference to FIG. 5, FIGS. 6A and 6B, FIGS. 7A and 7B, FIG. 8, and FIG. 9. Casing 48 includes an upper casing 158 and a lower casing 160 secured to one another by bolts 154 engaging threaded receivers. A plurality of apertures 162 may be disposed in lower casing 160 to assist in providing ventilation for motor 152. To induce ventilation of the casing and consequent airflow in and about electric motor 152, a fan 164, in the nature of a plurality of radial flanges or fins 166 may be secured to the interior upper surface of upper casing 158, as illustrated. Upon rotation of casing 48, fan 164 will rotate relative to the air within the casing. Such rotation will urge radial airflow along the outwardly flanges and downwardly along the interior surfaces of the casing with a corresponding drawing of air around and about shaft 130 and through motor 152. Furthermore, fan 164 serves in the manner of a heat sink. A secondary fan 170 is secured to upper casing 158 by a support structure 172 having an annular flange 174 bolted (as illustrated in FIG. 4), riveted, or otherwise secured to upper casing 158. As particularly shown in FIG. 8, fan 170 includes a plurality of blades 176 extending radially from a hub 177 and a sleeve 178, which sleeve circumscribes shaft 30. These blades may have an air foil cross-section, be twisted radially or simply be angled flat plates.

Figure 5:
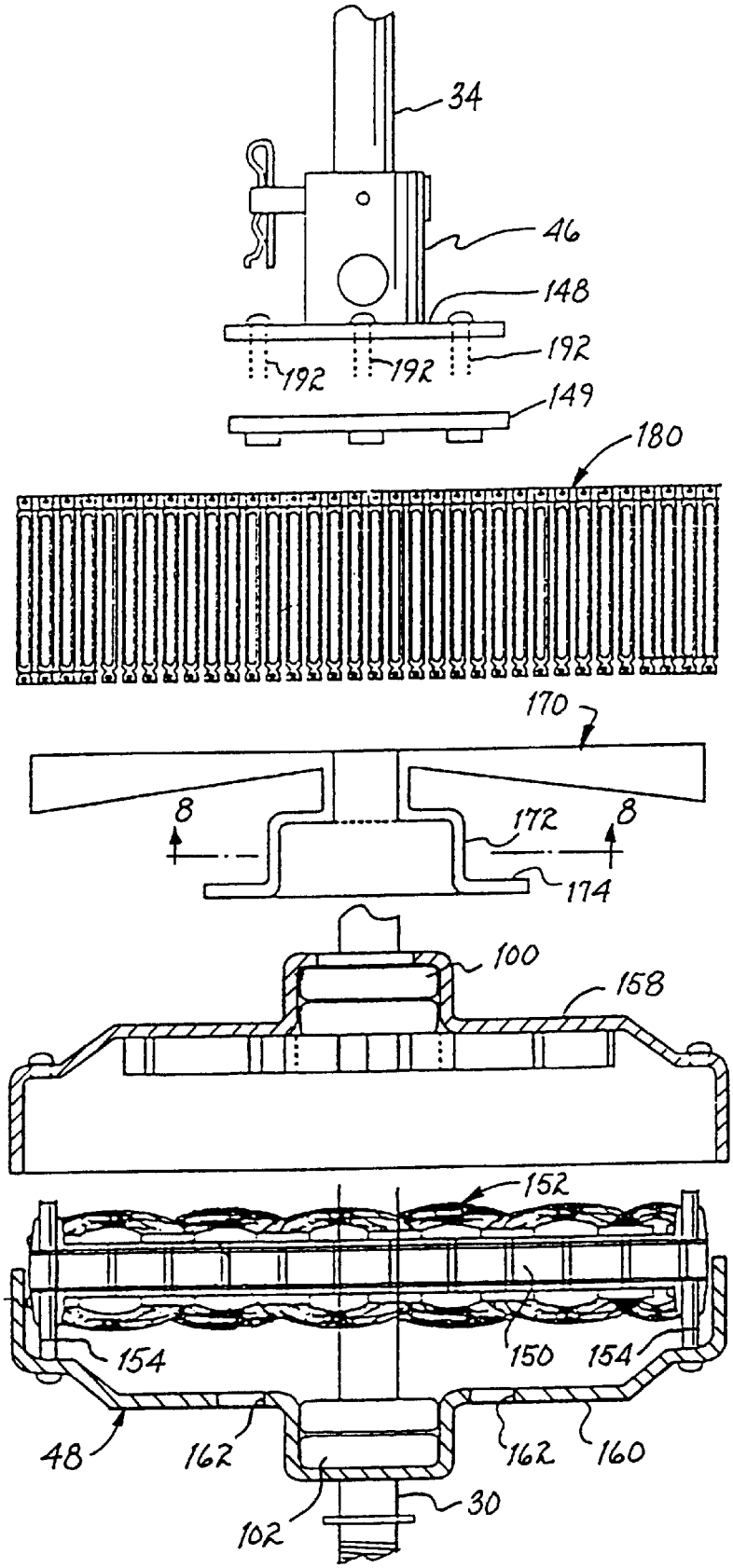
FIG. 5 is an exploded view of certain components of the room conditioner illustrated in FIG. 4.
Figure 7B:
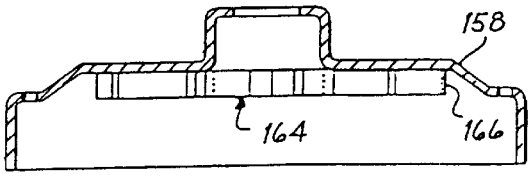
FIGS. 7A and 7B illustrate a top view and a cross-sectional view, respectively, of the upper motor casing shown in FIG. 5.
Figure 6B:
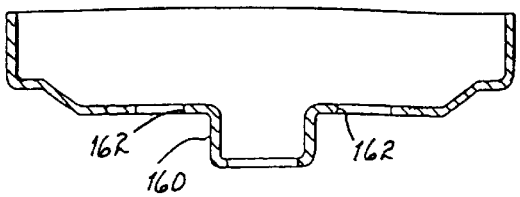
FIGS. 6A and 6B illustrate a bottom view and cross-sectional view, respectively, of the lower motor casing shown in FIG. 5.
Figure 7A:
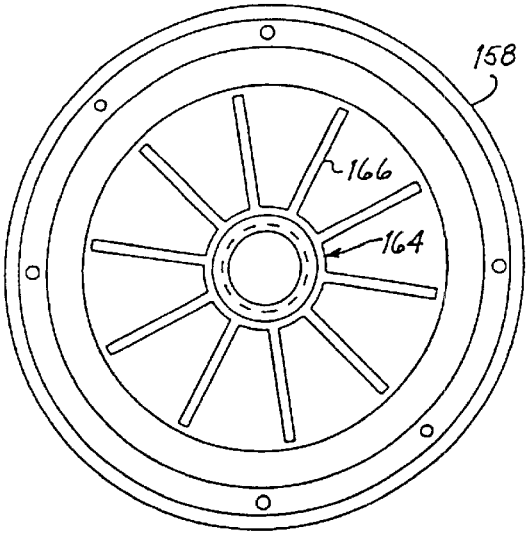
Figure 6A:
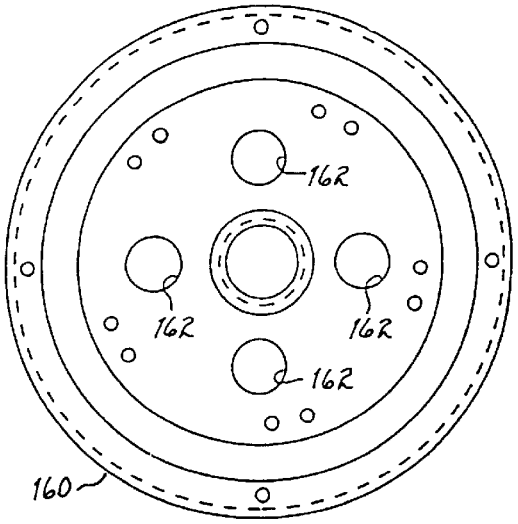
Figure 8:
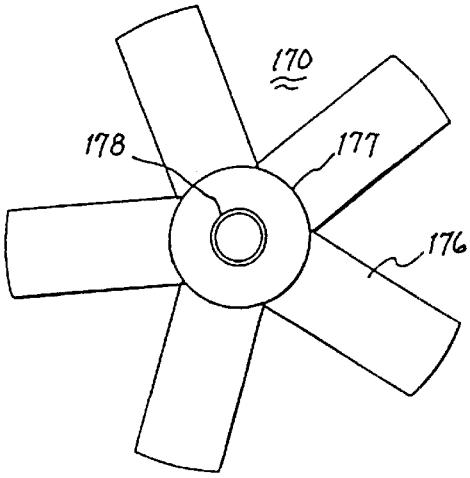
FIG. 8 shows a top view of a secondary fan shown in FIG. 5.
Figure 9:
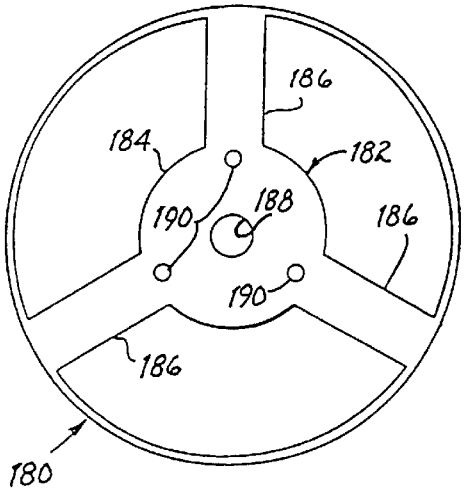
FIG. 9 shows a top view of the heating element shown in FIG. 5.

A heating element 180 is cylindrical, as illustrated in FIGS. 5 and 9. A support structure 182 extends across the top of the heating element and may include a hub 184 with three legs 186 extending therefrom into engagement with the top edge of the heating element. The hub is centrally apertured with aperture 188 to accommodate passage therethrough of shaft 30. Holes 190 are disposed in the hub to accommodate pass through of bolts extending downwardly from plate 148 to retain the support structure adjacent the internal surface of section 138 of upper housing 134, as shown in FIG. 4. A backing plate 149 may be used to engage bolts 192. The relative locations of fan 170 and heating element 180 positions the fan within and proximate the upper end of the heating element, as shown in FIG. 4.

Figure 10:
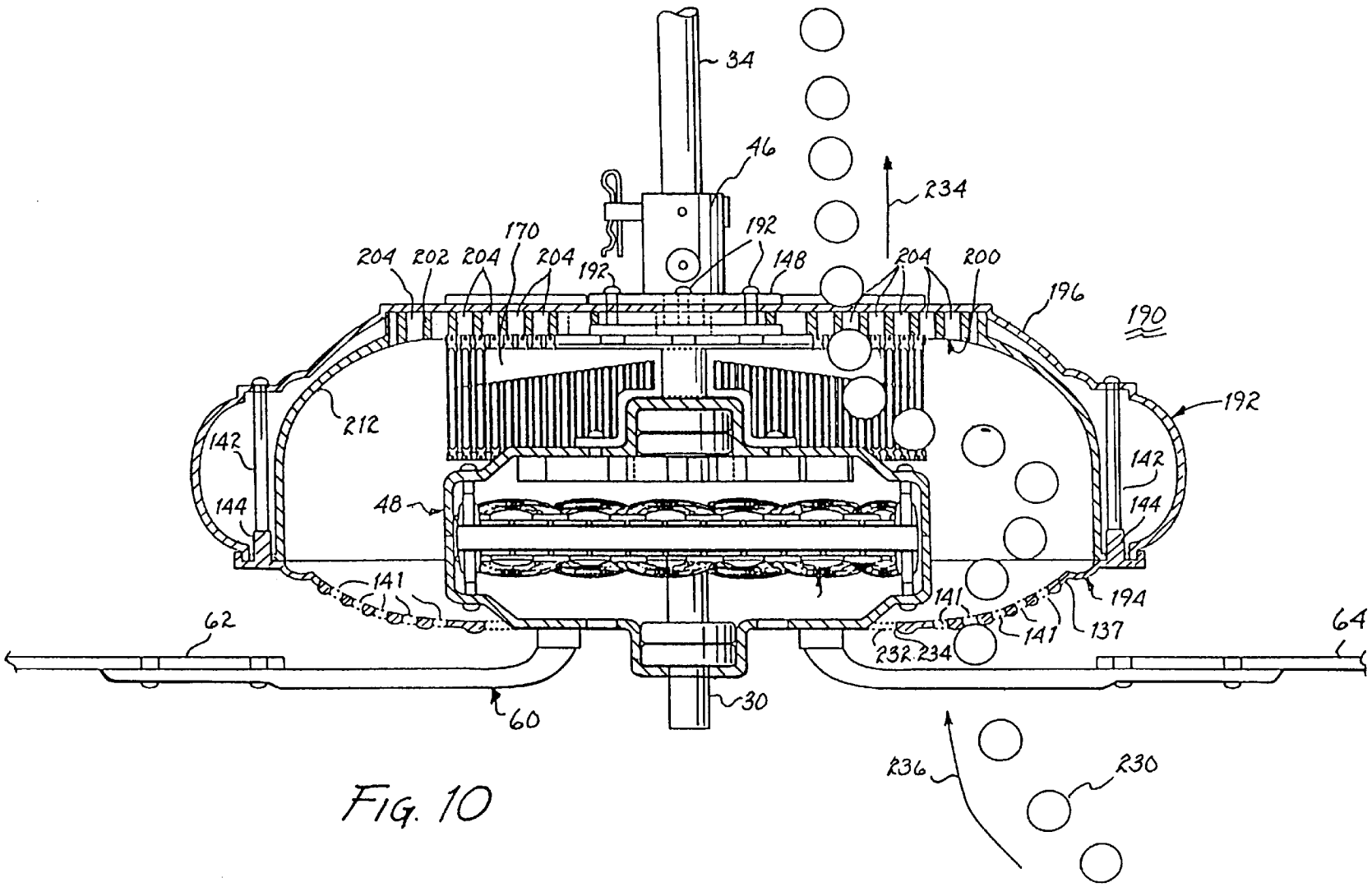
FIG. 10 illustrates a commercially viable room conditioner.
Figure 11B:
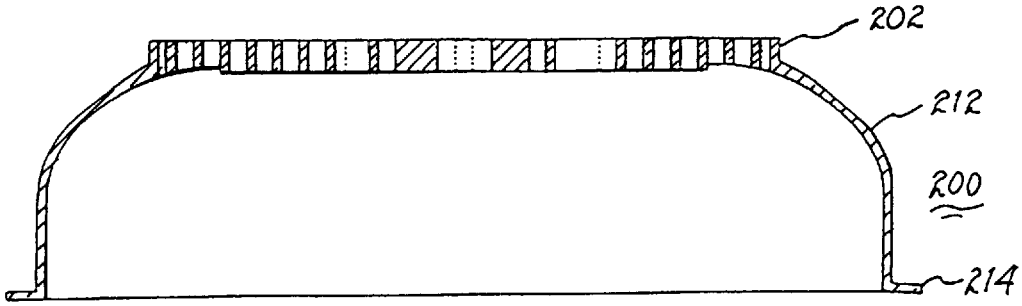
FIGS. 11A and 11B illustrate a top view and a side view, respectively, of a shroud illustrated in FIG. 10.
Figure 11A:
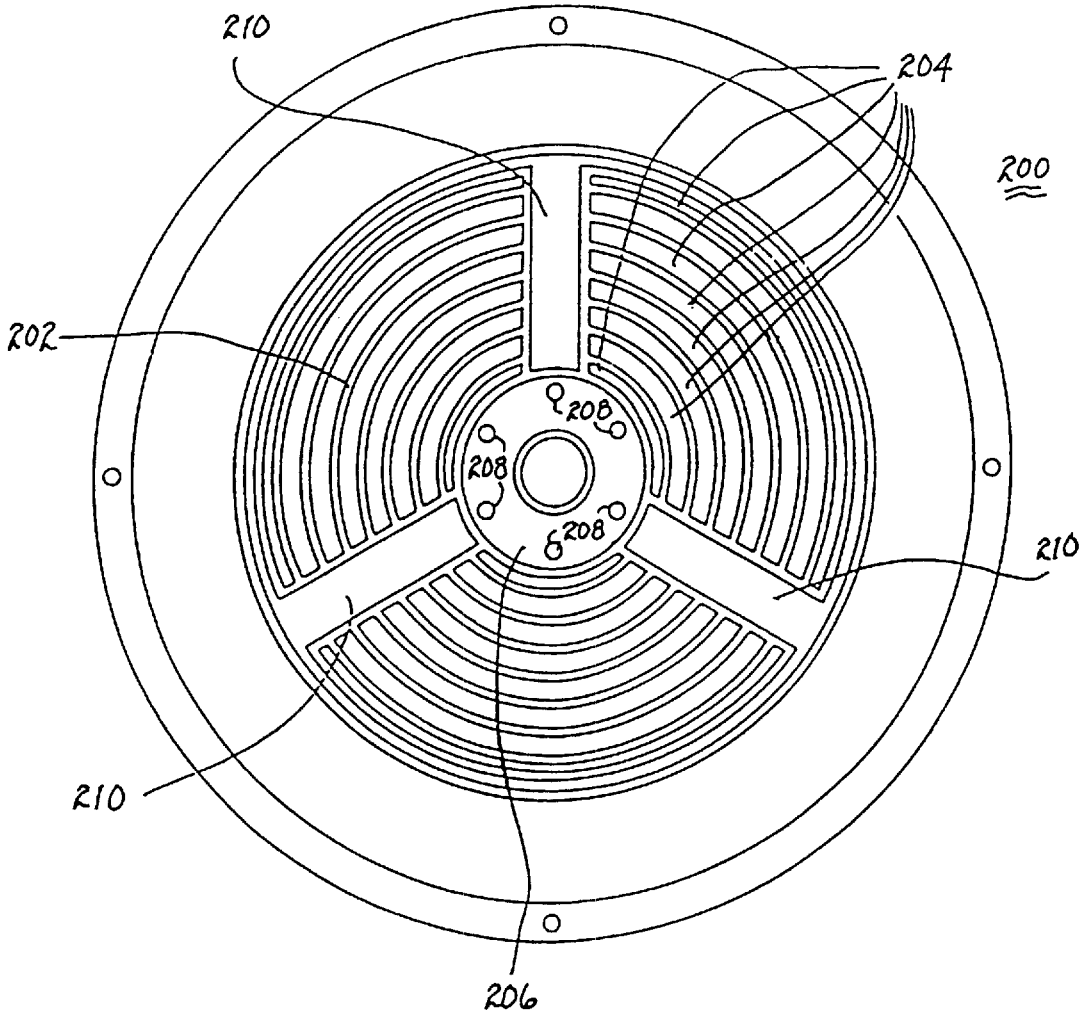
Figure 12:
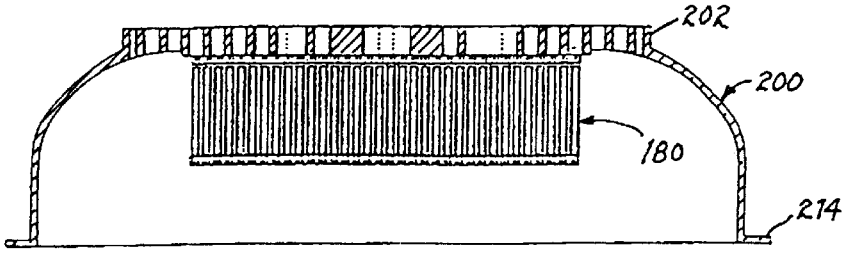
FIG. 12 illustrates a side view of the heating element mounted within a shroud.
Figure 13:
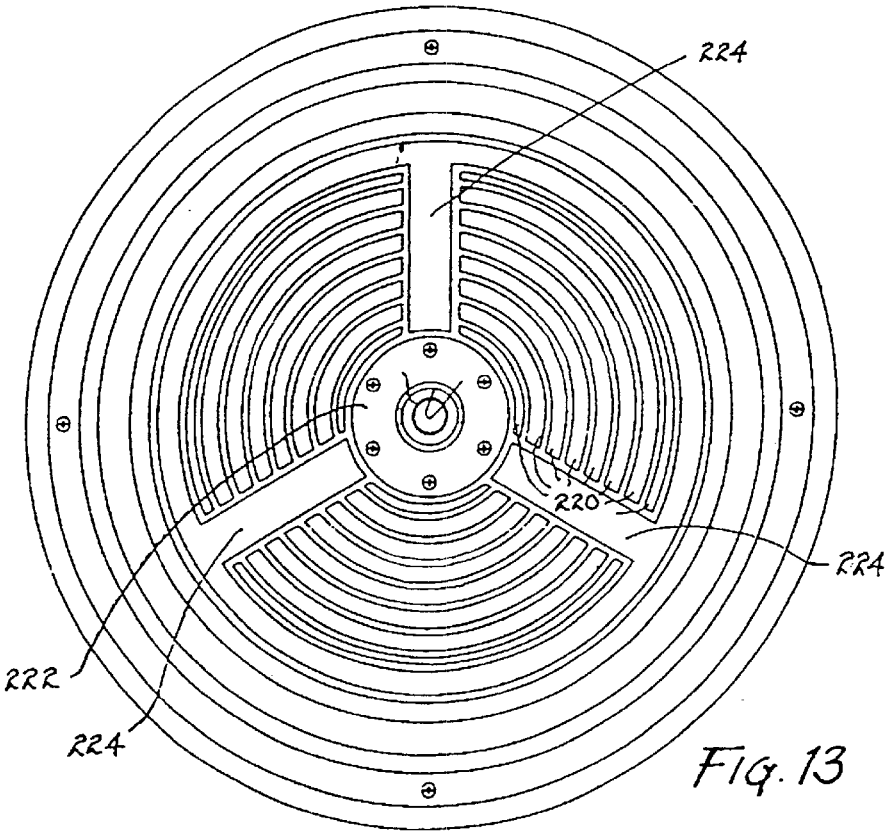
FIG. 13 illustrates a top view of the upper housing for the room conditioner, shown in FIG. 10.
Figure 14:
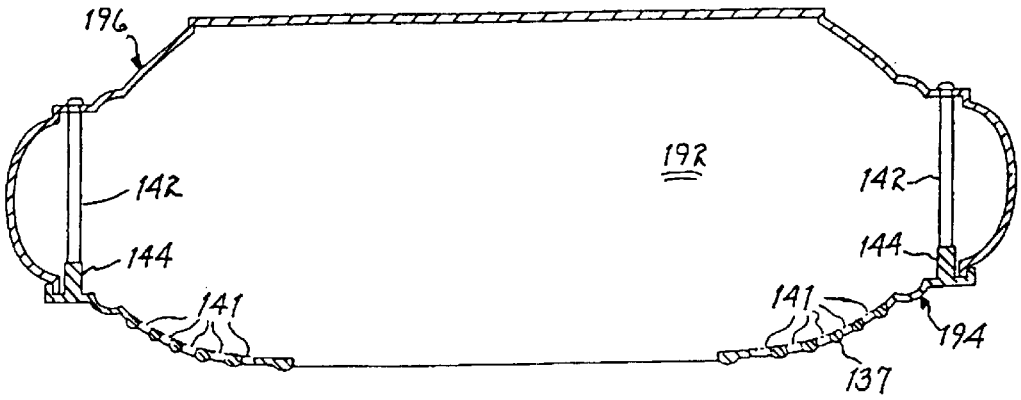
FIG. 14 illustrates a side view of the upper and lower housings for the room conditioner shown in FIG. 10.

Referring to FIG. 10, there is shown a variant 190 of a room conditioner which is very similar to variant 130 shown in FIG. 4. To describe the differences between variant 130 and variant 190 of the room conditioner, joint reference also will be made to FIGS. 11A, 11B, 12, 13 and 14. Housing 192 includes a lower housing 194 similar with lower housing 136 shown in FIG. 4. Lower housing 194 includes a section 137 having apertures 141 formed therein for ventilation purposes. It also includes threaded studs 144 for receiving bolts 142 to join lower housing 194 with upper housing 196. Neither upper nor lower housings of housing 192 serves a support function for any components; hence, the material of the housing may be dictated primarily by decorative considerations and may be made of metal, plastic, glass or components of the housing may have elements of these materials. Structural rigidity for the room conditioner is provided by internal shroud 200, depicted in further detail in FIGS. 11A and 11B. Shroud 200, or parts thereof, may be of thermally insulative material to prevent damaging heat radiation to the surrounding housing. Thereby, the material of the housing, such as housing 192, may be of any type of material dictated only by aesthetic considerations. The shroud includes a structural platform 202 of generally planar circular configuration. As particularly illustrated in FIG. 11A, it may include a plurality of concentric arcs 204 to provide for passage of air therethrough. A hub 206 includes a plurality of apertures 208 for penetrably receiving bolts extending from plate 148 secured to fixture 146. A plurality of spokes 210 extend equiangularly from hub 206. As noted in FIG. 11B, platform 202 may have significant thickness to provide the requisite strength and robustness to support heating element 180 depending therefrom, as depicted in FIG. 12. A circular skirt 212 extends radially and downwardly from platform 202 and terminates at a radial flange 214. The skirt serves the primary purpose of directing a flow of air into and through heating element 180. Radial flange 214 engages the junction between upper and lower housings 196, 194 and may be secured thereto by bolts or screws (not shown). As depicted in FIG. 13, upper housing 196 includes a plurality of concentric arc segments 220 extending radially from hub 222. These arc segments positionally correspond with arcs 204 disposed in internal shroud 200, as described above. Additionally, the upper housing includes spokes 224 corresponding with spokes 210 of the internal shroud. Central aperture 226 accommodates passage therethrough of shaft 30.

As depicted in FIG. 10, air molecules 230 are drawn into housing 192 by rotation of secondary fan 170, which fan creates an upward flow of air through the apertures or arcs in platform 202 and the associated section of upper housing 196. The airflow may be through apertures 141 in lower housing 194 as well as through annular space 232 intermediate edge 234 of the central aperture in the lower housing and the corresponding part of casing 48. The curvature of skirt 212 provides a relatively smooth and obstruction free passage to the air molecules to direct them essentially radially through and into heating element 180. These air molecules are heated as they flow past the heating element. Upon being heated, the air molecules rise, as depicted by the stream of air molecules 230 and arrow 234. While only one side of the airflow is depicted, it is to be understood that such airflow occurs all around the vertical axis (shaft 30). It may be noted that the inflow of air molecules into the room conditioner is depicted by arrow 236. As the air molecules flow upwardly above the room conditioner depicted by arrow 234, they are mixed with the upward airflow produced upon rotation of set of fan blades 60, of which fan blades 62, 64 are shown.

Figure 15:
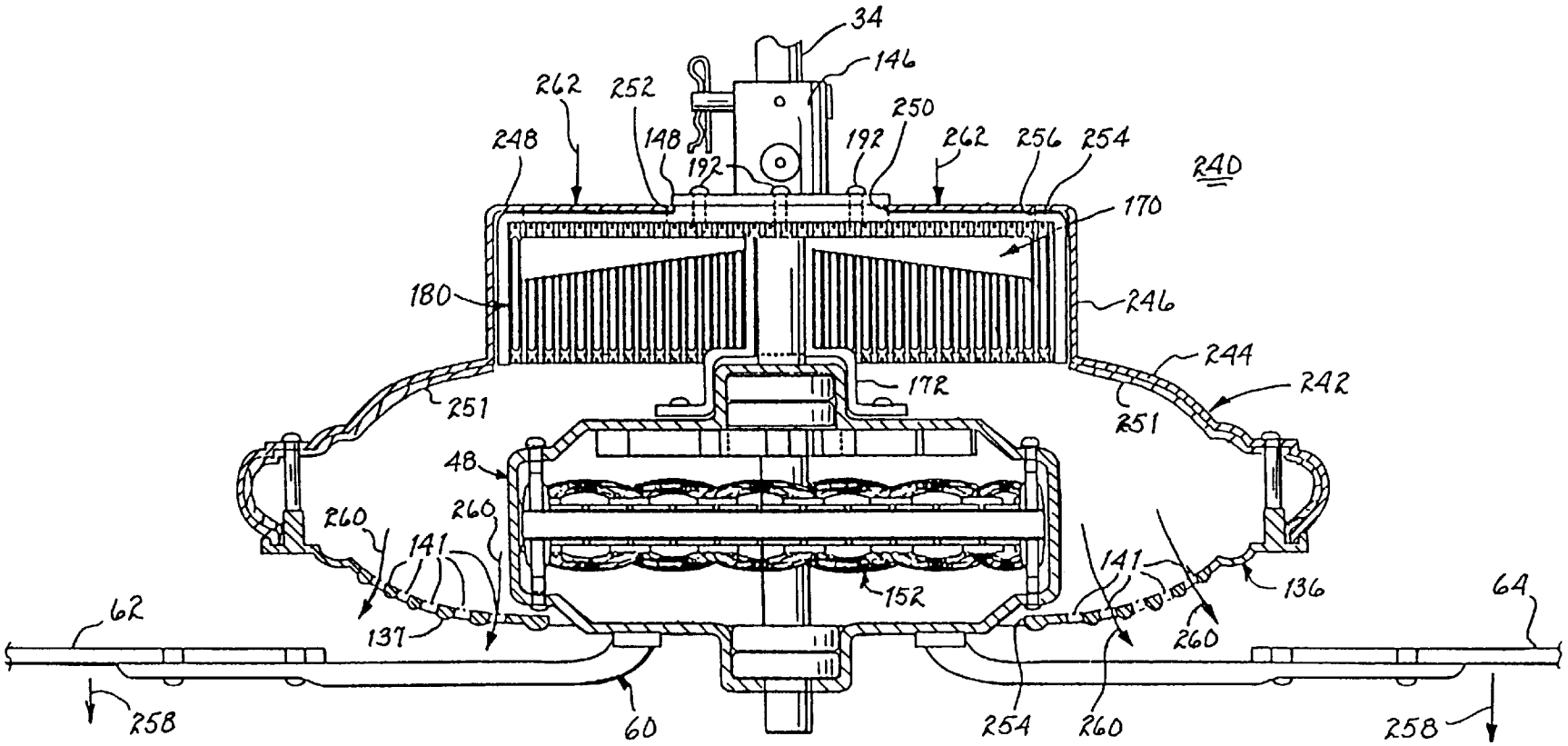
FIG. 15 illustrates a room conditioner having an upwardly displaced heating element.

FIG. 15 illustrates a variant 240 of the room conditioner shown in FIG. 4. Elements discussed below that are common to variant 130 (FIG. 4) will be assigned common reference numerals. Housing 242 includes a lower housing 136 like that shown in FIG. 4. Upper housing 244 includes an upwardly extending cylinder 246 having a top annular element 248 centrally apertured to define aperture 250. A lining 251 of thermally insulative material may be located interior of all or part of housing 242 to permit use of any aesthetically pleasing material for the housing. A plurality of apertures 252, which may be slots or holes of any shape or configuration, are disposed in top element 248. A cylindrical cap 254 is attached to plate 148 by bolts penetrably engaging the plate and the cap to retain the cap attached to fixture 146 and hence to sleeve 34. The cap includes a plurality of apertures 256 commensurate in configuration and location with apertures 252 disposed in top element 248. Accordingly, apertures 252 and 256 permit airflow into and out of cap 254. Heating element 180 is mounted and secured to plate 148, as described above. Secondary fan 170 and attendant support 172 is secured to casing 48 as described above. From the above description of variant 240 it becomes apparent that housing 242 is not a load bearing element and is dependingly supported upon cap 254. Accordingly, it may be of metal, plastic or glass having an aesthetically pleasing design.

If set of blades 60, of which blades 62 and 64 are shown, are caused to rotate by operation of motor 152 to produce a downward flow of air, as depicted by arrows 258, heated air will be drawn downwardly through variant 240. In particular, a low pressure environment will be created proximate the exterior of lower housing 136. The low pressure will cause air from within the housing to flow therefrom through apertures 141, as depicted by arrows 260. The resulting low pressure environment within housing 242 will draw replacement air through apertures 252 and 256 into contact with heating element 180. The airflow through these apertures, as depicted by arrows 262, will be enhanced by secondary fan 170 wherein its blades are configured to urge downward air movement upon rotation in the same direction as set of blades 60. The air flowing past the heating element will be heated by conduction and radiation. The heated air exhausting from housing 242 will be mixed with the downflowing air urged by set of blades 60 and the room will become warmed by the circulation of this mixed air.

If the direction of rotation of set of blades 60 and secondary fan 170 is reversed, the secondary fan will expel air from within the housing 242 through apertures 252, 256. The inflow of air into the housing will be through apertures 141 and through the annular space intermediate edge 254 of lower housing 136 surrounding the lower part of casing 48, as discussed above. Consequently, the airflow depicted by arrows 258, 260 and 262 will be reversed and the heated air exhausting through apertures 252, 256 will be mixed with the upward flow of air caused by set of blades 60.

Figure 16:
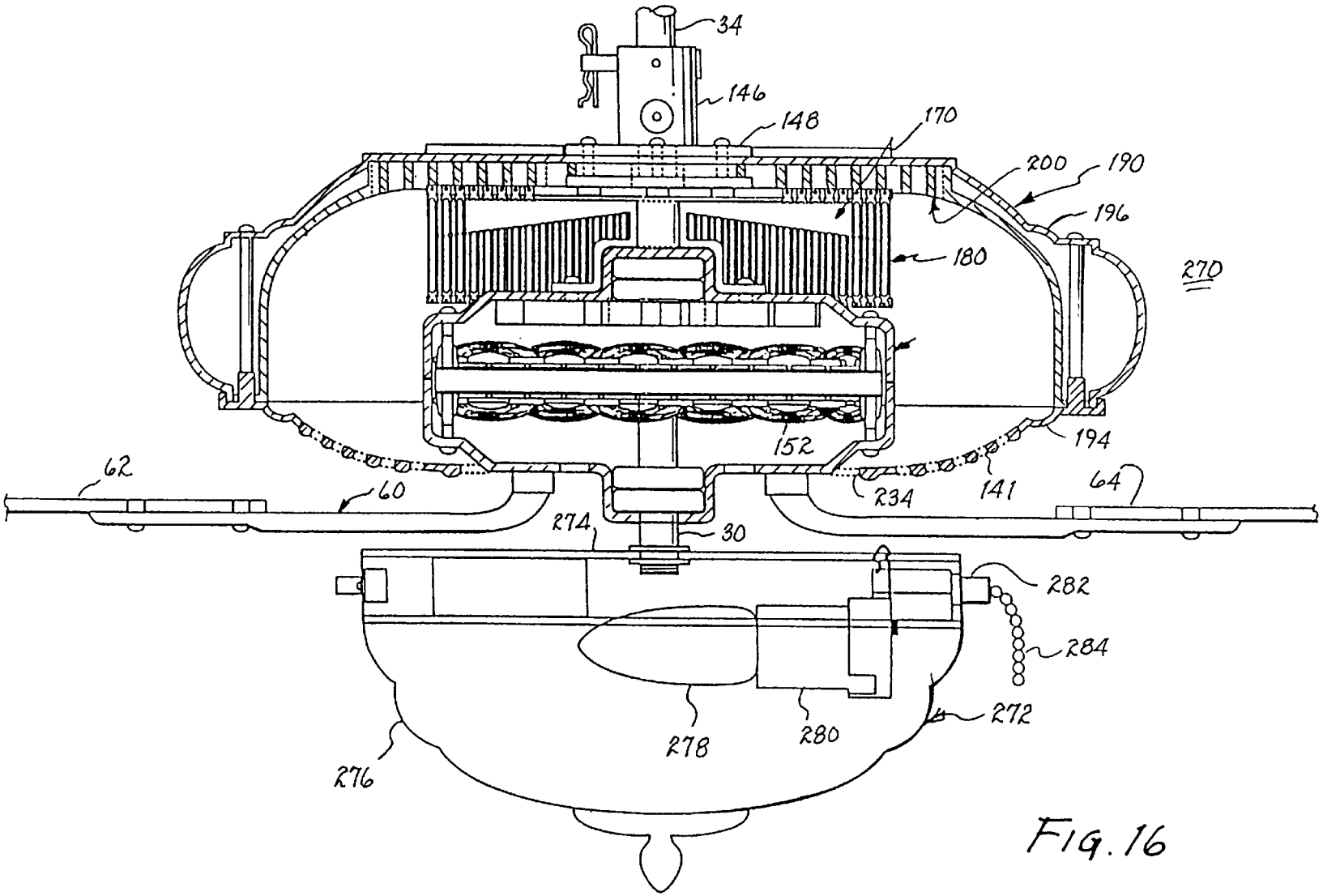
FIG. 16 illustrates a room conditioner shown in FIG. 10 having a light depending therefrom.

Referring to FIG. 16, there is illustrated a variant 270 of a room conditioner, which variant is similar to variant 190 illustrated in FIG. 10. In the description below, elements common with variant 190 will be assigned the same reference numerals. Many ceiling fans provide the dual function of circulating air and providing a source of light. For the latter purpose, variant 270 includes a light fixture 272 having a brace 274 for attachment to shaft 30. Light fixture 272 includes a transparent or translucent bowl 276. The material, configuration, and ornamentation attendant the bowl may be dictated primarily by aesthetic considerations. A light(s) 278 mounted within a receptacle 280 is disposed within the bowl and secured to brace 274 by suitable structure well known to those skilled in the art. An on-off switch 282 having a pull cord 284 depending therefrom may be used to provide selective energization of light 278.

Figure 17:
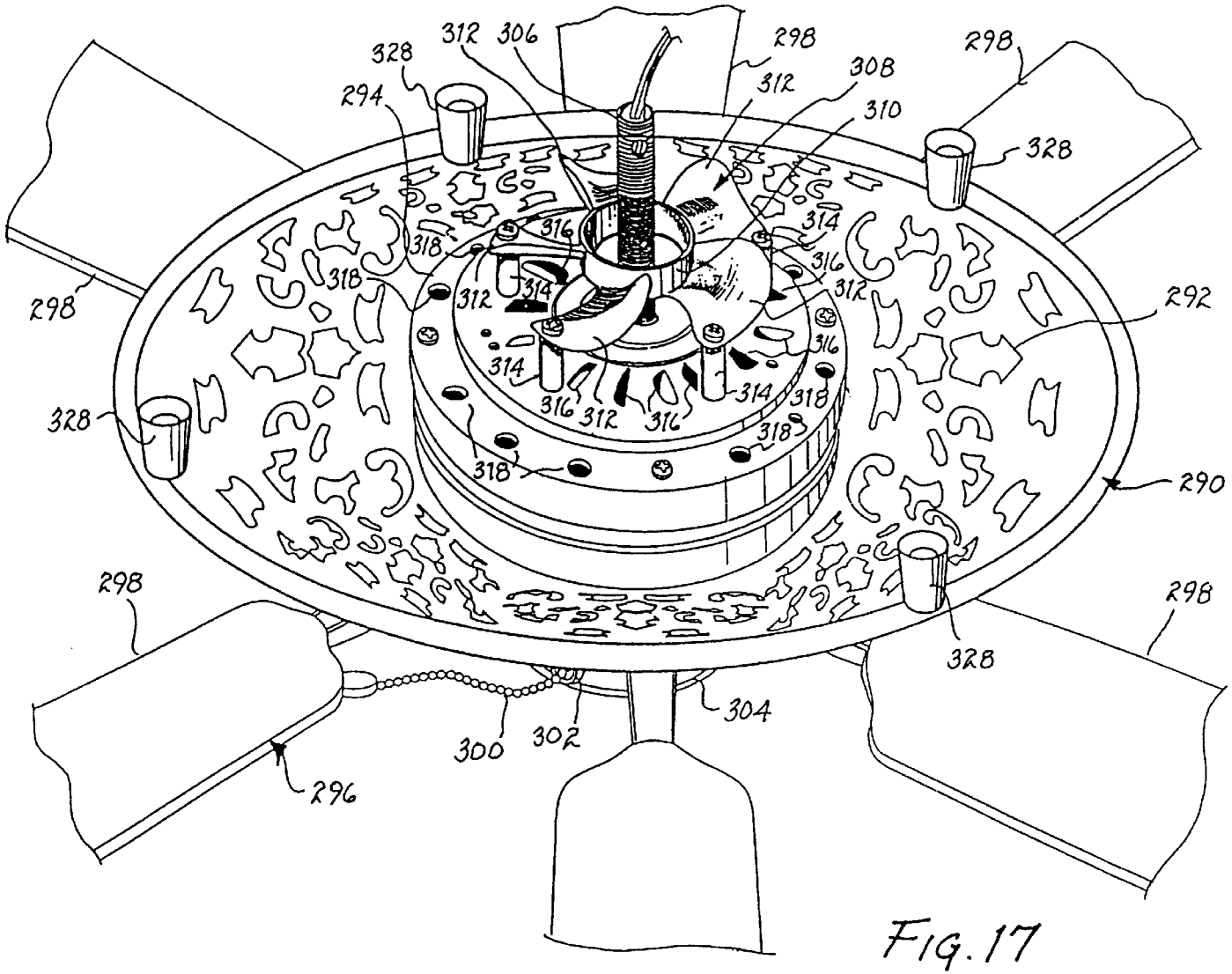
FIG. 17 illustrates the interior of the bottom half of a room conditioner having a casing mounted secondary fan.

FIG. 17 illustrates a lower housing 290 of a ceiling fan and having a plurality of randomly configured apertures 292; alternatively, these apertures may collectively represent a specific design. A casing 294 is located proximate the center bottom of lower housing 290 and houses an electric motor to rotate a set of blades 296, of which six equiangularly oriented blades 298 are illustrated in part. Moreover, a pull cord 300 extends from a switch 302 mounted in a box 304 as shown to regulate operation of the ceiling fan. A non-rotating shaft 306 extends upwardly from casing 294 and has attached thereto the stator (not shown) of the motor disposed within casing 294. The casing is attached to the rotor of the motor. Accordingly, the casing, and set of blades 296 attached thereto, will rotate upon energization of the motor. Lower housing 290 is secured through its mating upper housing (not shown) to shaft 306 and is a non-rotating element.

A secondary fan 308 includes a hub 310 supporting each of fan blades 312, which hub is not in contacting engagement with shaft 306. Support for fan 308 is provided by each of a plurality of stanchions 314 extending upwardly from casing 294. Thereby, rotation of casing 294 will produce commensurate rotation of fan 308, which rotation will result in a commensurate airflow. For reasons which will become apparent below, casing 294 includes a plurality of vents 316. Further vents 318 may also be embodied.

Figure 18:
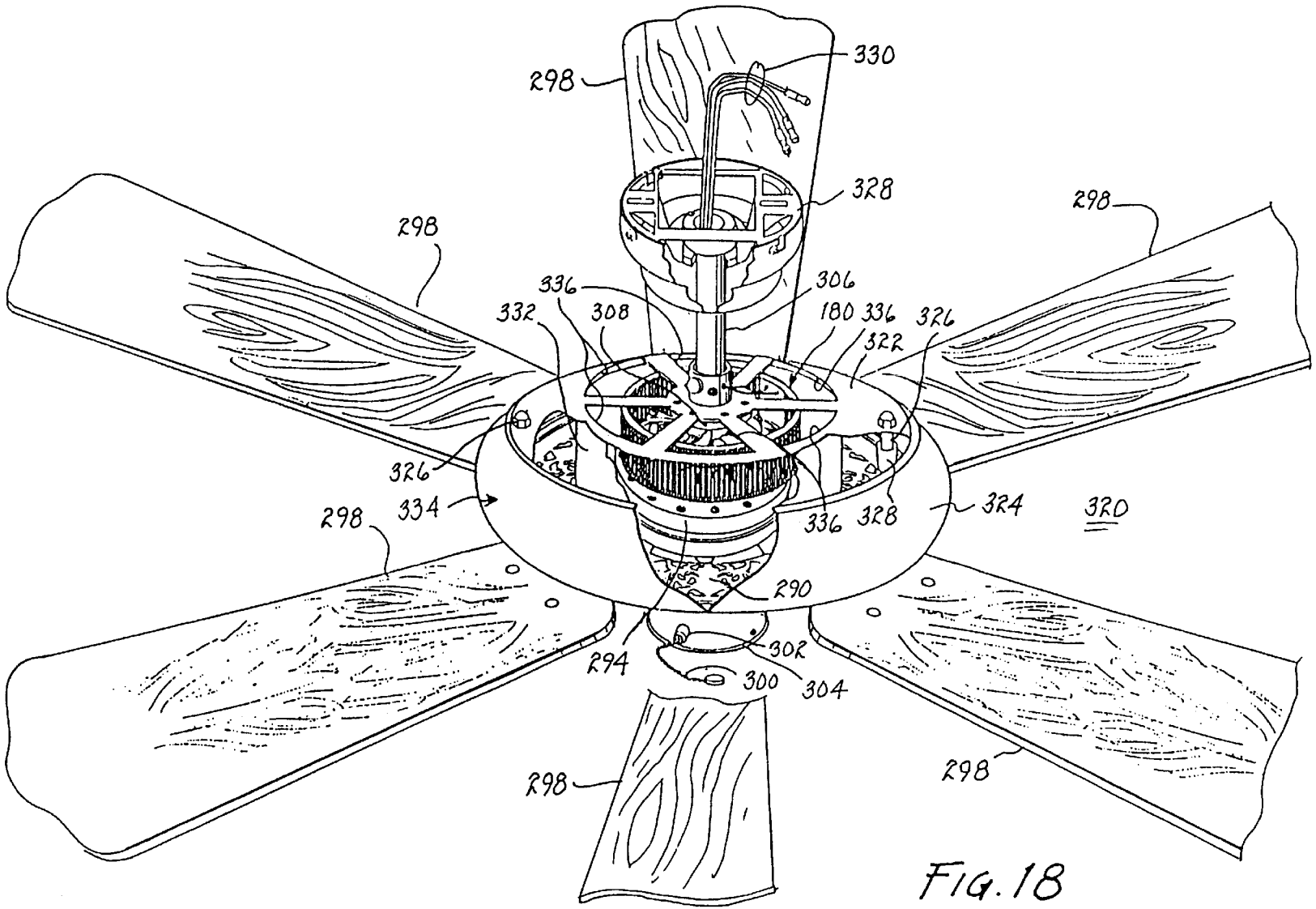
FIG. 18 illustrates a room conditioner incorporating the secondary fan shown in FIG. 17.

FIG. 18 illustrates a variant 320 of a room conditioner embodying the structure shown in FIG. 17 described above. FIG. 18 includes cutaway portions to illustrate various internal components thereof. An upper housing 334, which may include circular sidewall 324, is attached to lower housing 290 by a plurality of bolts 326 engaging receivers 328 extending from the lower housing. A heating element 180, like the heating elements described above, depends from upper housing 322 and circumscribingly encloses fan 308 attached to and extending upwardly from casing 294. A fixture 328 is secured to shaft 306, or an extension thereof, and supports variant 320 from a ceiling or like structure. Electrical conductors 330 extend from fixture 328 for connection to a source of electrical power to operate the motor within casing 294 and heating element 180; these conductors may also be connected to a thermostat to permit control of operation of the heating element. A cylindrical shroud 332 may be disposed within housing 334 formed by lower housing 290, upper housing 322 and cylindrical sidewalls 324 to circumscribe casing 294 and heating element 180. This shroud is preferably radially outside of apertures 336 disposed in upper housing 322. The shroud serves the function of controlling airflow to and from the heating element. Moreover, all or part of housing 334 and particularly shroud 332 may be of thermally insulative material.

Figure 19:
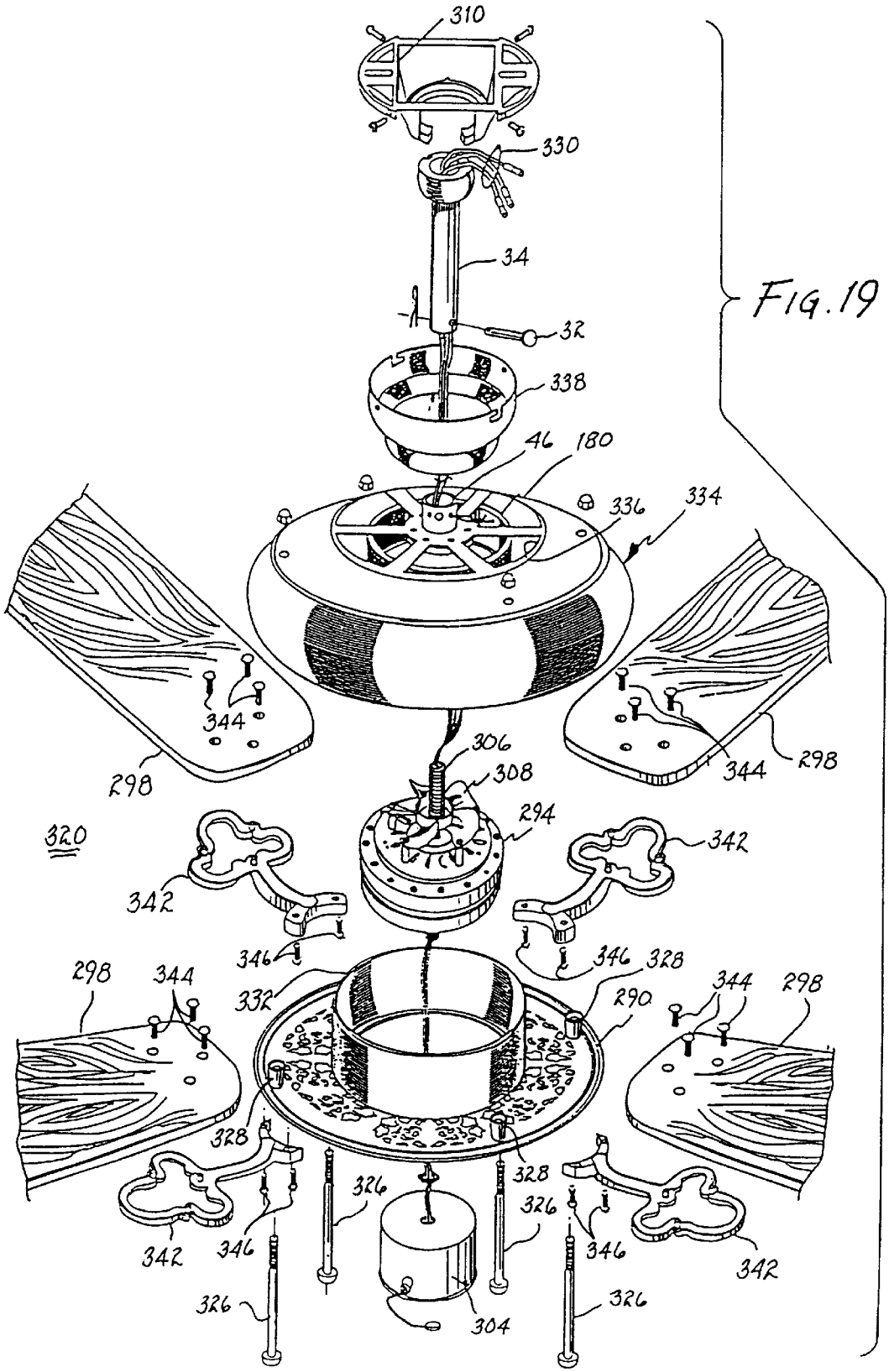
FIG. 19 illustrates an exploded view of the room conditioner shown in FIG. 18.

FIG. 19 is an exploded view of variant 320 of the room conditioner shown in FIG. 18. In addition to the elements described above, fixture 328 (see FIG. 18) is illustrated to include enclosure 338 and support 340. Only four fan blades 298 are illustrated in FIG. 19. It is to be understood that variant 320 may have six blades, as depicted in FIG. 18, four blades as depicted in FIG. 19 or a different number of blades, depending upon a number of factors. Attachment devices 342 are illustrated to interconnect blades 298 with the bottom of casing 294. Attachment is accomplished by screws 344 securing a blade to an attachment device and screws 346 securing the attachment device to the casing.

Figure 20:
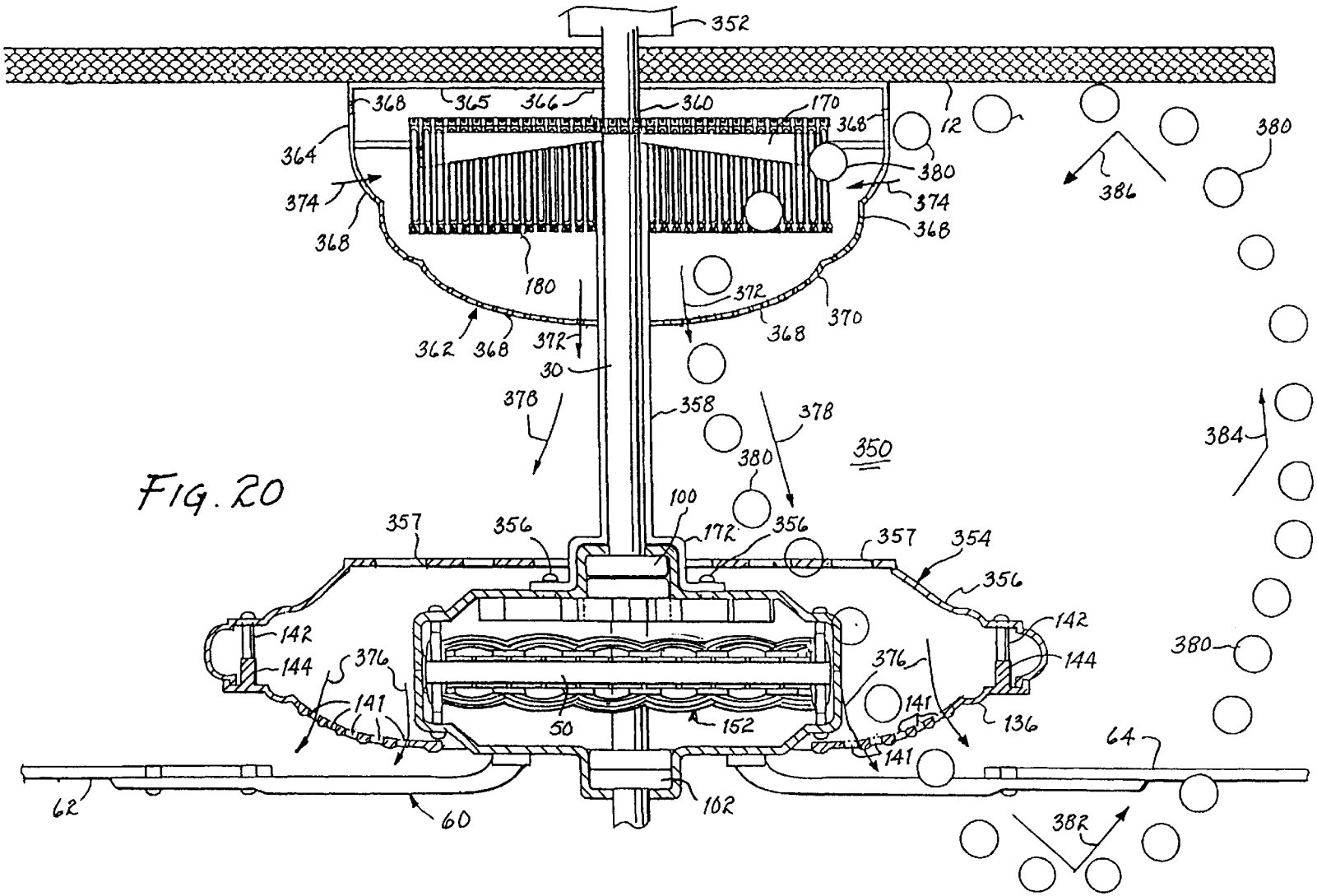
FIG. 20 illustrates a room conditioner having an heating element displaced upwardly of a ceiling fan.

Referring to FIG. 20, there is shown a variant 350 of the above-described room conditioner. Elements common with previously described room conditioners will be assigned common reference numerals for purposes of consistency and clarity. A stationary shaft 30 extends downwardly from a location proximate ceiling 12 to support the room conditioner. The structure described above with respect to room conditioner 10 shown in FIG. 10 may, for instance, be used. For purposes of simplification, support 352 is illustrated as representative of apparatus for dependingly supporting shaft 30. The shaft supports motor 152 having a stator (not shown) secured to shaft 30 and a rotor 50 secured to casing 48. The casing is mounted upon shaft 30 via bearings 100, 102, as described above. A housing 354 is disposed about casing 48. This housing includes an upper housing 356 and a lower housing, which may be like previously described lower housing 136. Bolts 142 threadedly engage studs 144 to retain lower housing 136 with upper housing 356. Housing 354 may be secured to casing 48 to rotate therewith; alternatively, the housing may be secured to shaft 30 directly or indirectly by means well known to those skilled in the art (not shown) to preclude rotation of the housing upon rotation of casing 48. A set of blades 60, of which blades 62, 64 are shown, are mounted upon and extend from casing 48. Thereby, the set of blades will rotate upon rotation of the casing.

Figure 21:
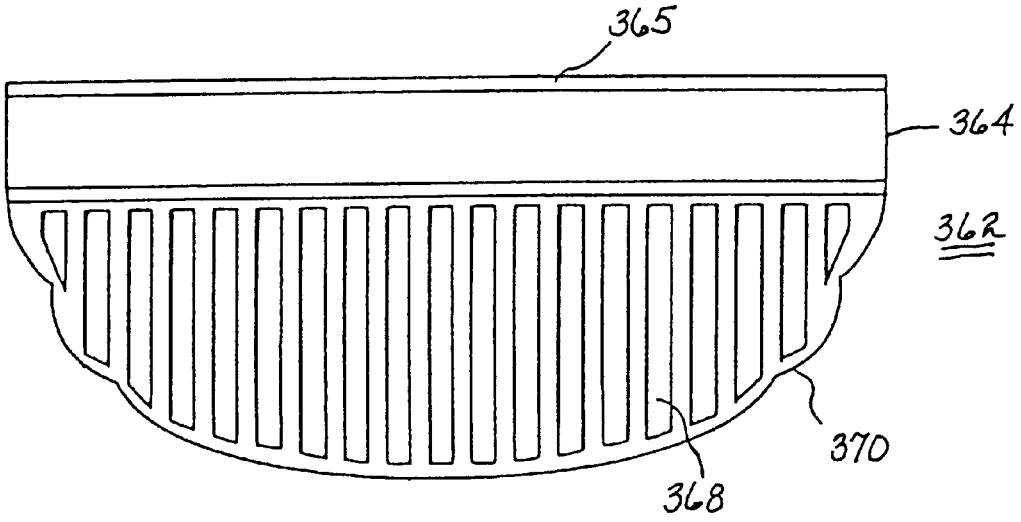
FIG. 21 illustrates an apertured cover for the heating element shown in FIG. 20.

A support 172 is attached to casing 48 by means of bolts 356, or the like. Support 172 includes an upwardly extending sleeve 358 rotatably mounted about shaft 30. The upper end of the sleeve supports a fan 170 at its hub 177 (see FIG. 8). A heating element 180 is secured in a non-rotating relationship with shaft 30 through a collar 360 secured to hub 184 (see FIG. 9) of the heating element. A cover 362 includes a mounting 364 which may be attached to ceiling 12 in a conventional manner. Alternatively, base 365 of the cover may be attached to shaft 30 via a collar 366. As particularly shown in FIG. 21, cover 362 includes a plurality of apertures 368, such as the slots shown, disposed in a bowl-like element 370 dependingly secured to mounting 364 or base 365. It is to be understood that cover 362 may be configured primarily with consideration for its ornamental value and for aesthetic purposes. Moreover, it is to be understood that mounting 364 may also include apertures 368 in the form of the slots or other configurations to enhance airflow into and out of the cover.

Variant 350 of the room conditioner may be used for the purpose of urging airflow downwardly through rotation of set of blades 60 and mixing therewith heated air resulting from operation of heating element 180. More particularly, upon rotation of set of fan blades 60, secondary fan 170 will rotate in conformance therewith due to the interconnection via sleeve 358.

Rotation of secondary fan 170 will result in an airflow downwardly through the middle of heating element 180 and through apertures or slots 368, as depicted by arrows 372, in element 370. Air will be drawn into cover 362 through mounting 364, if apertured, or through the upper ones of apertures or slots 368. Such inflowing air, represented by air molecules 380, and depicted by arrow 374 will flow through the slots of heating element 180. Upon such flow, the air molecules would become heated by conduction and radiation. In response to operation of secondary fan 170, the air molecules will be urged into a downward flow in general axial alignment with shaft 30. Simultaneously, set of blades 60 rotates to urge a downward flow of air. Such operation of the set of blades will create a below ambient pressure environment below casing 48 and below lower housing 136. As a result of this low pressure area, air will be drawn from within housing 354 through apertures 141, as depicted by arrows 376 and through the annular space between the casing and the aperture. The resulting low pressure environment within housing 354 will draw air molecules 380 into the housing through apertures 357 disposed in upper housing 356; this downward flow of the air molecules is depicted by arrows 378. As the warmed air exits downwardly from within housing 354, such as through apertures 141 in lower housing 136, it will become mixed with the airflow produced by set of blades 60 and gently warm the space within which variant 350 is mounted. As representatively indicated by arrow 382, the warmed airflow will bounce off the floor and furniture outwardly toward the walls and flow upwardly therealong, as depicted by arrow 384. Upon reaching ceiling 12, the rising warmed air will flow toward heating element 180 within cover 362 due to operation of secondary fan 170, as depicted by arrows 386. Although air molecules 380 and the corresponding arrows described above are primarily depicted on one side of variant 350 shown in FIG. 20, it is to be understood that such air movement occurs radially all about shaft 30.

The heated airflow flowing through housing 354 may heat casing 48 and motor 152 therein. To prevent overheating of the motor and to thermally insulate the motor from the heated airflow, casing 48 may be of thermally insulative material. Materials are well known in the art that provide thermally insulation and also the requisite structural strength in order for the casing to function as intended. To prevent heated airflow around and about casing 48 within housing 354 and to prevent any heating of the casing and motor 152 therein, apertures 357 in upper housing 356 may be eliminated. In such event, heated air molecules 380 would flow around housing 354 and be drawn into and mixed with the airflow generated by set of blades 60.

In the configuration depicted in FIG. 20, variant 350 of the room conditioner is particularly adapted for downward flow of heated air. Thus, by not energizing heating element 180, the room conditioner can serve the normal function of a ceiling fan to circulate air within a space and provide a commensurate cooling effect upon any occupants.

The direction of rotation of set of blades 60 and secondary fan 70 may reversed to cause an upward flow of air by operation of the set of blades and an upward and lateral airflow produced by the secondary fan 70 drawing air through and past heating element 180. The heated airflow from the heating element will mix with the airflow from set of blades 60 proximate the ceiling. Thereafter, the warmed airflow will gently circulate throughout the space within which variant 350 is mounted. The upward airflow generated will also have the effect of precluding heated air entering the housing to heat casing 48. Moreover, it will prevent heating of housing 354 and provide additional latitude in the selection of materials for the housing.

Figure 22:
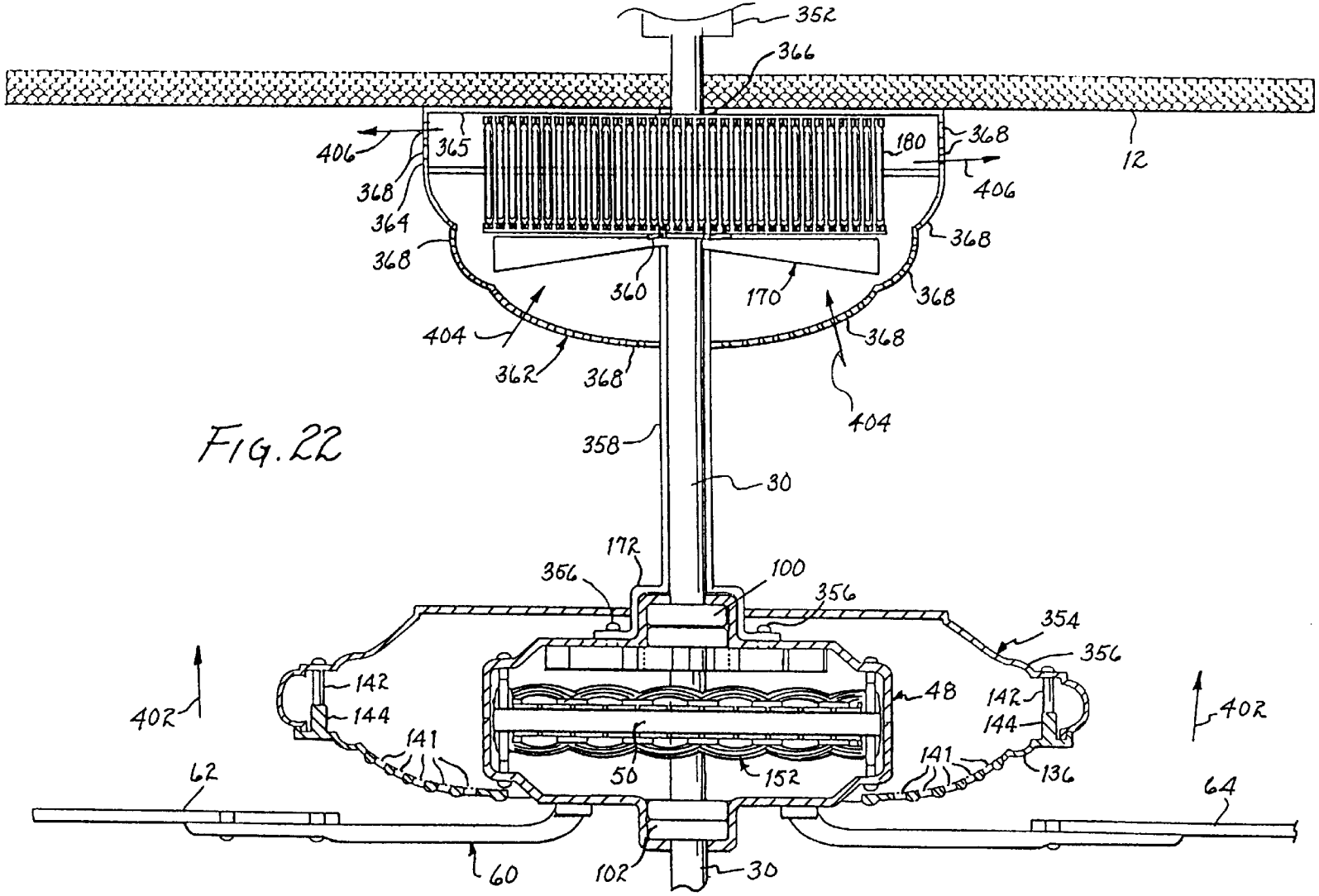
FIG. 22 illustrates a room conditioner like that shown in FIG. 20 but with a differently configured heating element assembly.

A variant 400 of a room conditioner better adapted to provide upward ambient airflow and upward heated airflow than variant 350 shown in FIG. 20 is shown in FIG. 22. Due to the significant commonality of elements shown in FIGS. 20, 21 and 22, common reference numerals will be used for the same elements. Moreover, the following description will be primarily directed to the structural and functional differences between variants 350 and 400. Support 172 is attached to casing 48 by bolts or screws 356 to rotate therewith. Sleeve 358 encircling shaft 30 extends upwardly from the support. Secondary fan 170 is attached via its hub 177 (see FIG. 8) to a collar 360 secured to sleeve 358; alternatively, the collar may be a radial flange formed as part of the sleeve. If such flange is employed, it would be located below hub 177 of the secondary fan instead of above it as depicted. Heating element 180 is secured to shaft 30 via a collar 366 for engagement with hub 184 (see FIG. 9) of the heating element. Preferably, heating element 180 is located proximate ceiling 12, as depicted. Cover 362 may be attached via base 365 to ceiling 12 or formed as a part of variant 400 by attaching it to shaft 30. Preferably, secondary fan 70 is axially displaced to be positioned at the lower end of the heating element 180, as depicted, in order to cause airflow into the heating element and permit outflow of heated air throughout the full length of the slots formed in the heating element.

Housing 354 may be attached to support 172 for rotation with casing 48. Alternatively, structure or means well known to those skilled in the art may be incorporated to maintain housing 354 in a stationary relationship with shaft 30. Lower housing 136 may include a plurality of apertures 141 for air circulation into and out of housing 354 and thereby exhaust heat from the casing 48 as a result of convective activity of the air within the housing.

Upon rotation of set of blades 60 to cause an upward airflow, as depicted by arrows 402, the air will flow upwardly towards ceiling 12 and toward cover 362. Due to the commensurate rotation of secondary fan 170, it will urge an upward airflow into heating element 180. Such upward air movement will cause air to be drawn into cover 362 through lower aperture/slots 368, as depicted by arrows 404. The drawn-in air will be urged into the interior of heating element 180 and discharged therefrom through the slots of the heating element. The discharged air heated by the heating element will be exhausted through upper apertures/slots 368 in the cover proximate the ceiling 12, as depicted by arrows 406. The heated airflow will mix with the upwardly moving airflow caused by set of fan blades 60. The resulting warm air will be circulated throughout the space wherein variant 400 is located to gently and uniformly heat the space.

Appropriate electrical connections between motor 152 and heating element 180 are present, as described with reference to FIG. 2, although not shown in FIG. 20 or 22. The attendant thermostat controlling operation of heating element 180 can be used to regulate the temperature of the space wherein variant 400 is located. When the room conditioner is to be used primarily to cool occupants of the space wherein the variant is located, heating element 180 would be de-energized and set of blades 60 would perform the normal function of a conventional ceiling fan.

Variant 400 illustrated in FIG. 22 is particularly adapted for producing an essentially upward flow of warmed air away from housing 354 as the air heated by heating element 180 is not directed to and about casing 48 containing motor 152. Thereby, the heated air flowing from heating element 180 does not contribute directly nor indirectly to elevating the operating temperature of the motor.

If motor 152 is energized to rotate set of blades 60 to cause a downward flow of air, the normal cooling functions of a ceiling fan will be present, assuming that heating element 180 is not energized. However, if beating element 180 is energized and secondary fan 170 is caused to rotate to draw heat from the heating element, the heated air will be exhausted through apertures/slots 368 of cover 362 in a direction reverse of that illustrated by arrows 404. The ambient air external of cover 362 will be drawn into the cover in a reverse direction from that depicted by arrow 406. The resulting flow of heated air will be drawn downwardly by operation of set of blades 60 to flow around and about housing 354 and become mixed with the airflow generated by the set of blades. By omitting apertures 357 in upper housing 356 (see FIG. 20), the downward flowing heated air will not enter the housing and the heated air will have little, if any, effect upon the temperature of casing 48 and enclosed motor 352.

The housing is depicted in the figures as primarily a decorative enclosure having a primary purpose of hiding casing 48 and other functional elements. Accordingly, the housing may be eliminated without compromising operation of any of the room conditioners illustrated and described above.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. A room conditioner for heating a room, said room conditioner comprising in combination:

(a) at least one support, supported from an upward location;

(b) a motor adapted to said at least one support for rotating at least one fan blade to produce an upward first airflow;

(c) a casing for enclosing said motor;

(d) at least one heating element isolated from said motor; and (e) means for generating a second airflow, said means interconnected with said casing for urging airflow past at least one of said at least one heating elements to produce a heated second airflow.

2. A room conditioner for heating a room, said room conditioner comprising in combination:

(a) an air distribution device having at least one motor and at least one fan blade for creating a first upward airflow;

(b) at least one support for supporting said air distribution device;

(c) at least one heating element displaced upwardly from said air distribution device; and (d) at least one secondary fan blade displaced upwardly from said air distribution device and disposed external of said at least one heating element, said at least one secondary fan blade including at least one fan blade for conveying a second airflow from said at least one heating element into the first upward airflow to mix with and heat the first upward airflow.

3. A room conditioner for heating a room, said room conditioner comprising in combination:

(a) an air distribution device having at least one motor and at least one fan blade for creating a first upward airflow;

(b) at least one support for supporting said air distribution device;

(c) at least one heating element displaced upwardly from said air distribution device; and (d) at least one secondary fan blade displaced upwardly from said air distribution device, said at least one secondary fan blade including radially extending fan blades for conveying a second airflow from said at least one heating element into the first upward airflow to mix with and heat the first upward airflow, said at least one secondary fan blade being at the upstream end of said at least one heating element to induce a flow of air through said at least one heating element.

4. A room conditioner for heating a room, said room conditioner comprising in combination:

(a) at least one support, supported from an upward location;

(b) at least one housing, enclosing at least one of the following components:

(i) at least one motor;

(ii) at least one fan blade responsive to rotation of said at least one motor for creating an upward airflow;

(iii) at least one heating element for heating air flowing therepast, at least one of said heating elements being located upwardly of said motor; and (iv) at least one secondary fan blade rotationally responsive to rotation of said at least one motor for urging a flow of air past at least one of said heating elements for mixing with a flow of air generated by said least one fan blade upon energization of said motor.

5. The room conditioner as set forth in claim 4 wherein at least one of said heating elements is permeable and wherein said secondary fan blade is located adjacent at least one of said permeable heating elements.

6. The room conditioner as set forth in claim 5 wherein said at least one secondary fan blade is disposed in the alternative either interiorly or exteriorly of at least one of said permeable heating elements.

7. The room conditioner as set forth in claim 4 wherein at least one of said heating elements comprises a solid element for air to pass over.

8. The room conditioner as set forth in claim 7 wherein said at least one secondary fan blade is disposed in the alternative either interiorly or exteriorly of said at least one solid element.

9. The room conditioner as set forth in claim 4 including a cover for enclosing at least one of the following components: i) said at least one heating elements, and ii) said at least one secondary fan blade, said cover including at least one inlet and at least one outlet for passage of the heated air from at least one of said at least one heating elements.

10. The room conditioner as set forth in claim 9 wherein said cover has at least one opening for each of egress and ingress of airflow in response to said at least one secondary fan blade.

11. The room conditioner as set forth in claim 4 including means for interconnecting said at least one secondary fan blade and said at least one motor and for locating said at least one secondary fan blade proximate at least one of said heating elements.

12. The room conditioner as set forth in claim 11 wherein said interconnecting means comprises at least one support adapted to said at least one motor for supporting said at least one secondary fan blade.

13. The room conditioner as set forth in claim 11 wherein at least one of said heating elements and said at least one secondary fan blade are located adjacent the ceiling of the room.

14. A room conditioner for selectably heating or cooling a room, said room conditioner comprising in combination the following components:

(a) at least one support, supported from an upward location;

(b) at least one motor adapted to said at least one support, for rotating at least one fan blade to produce a first upward airflow for heating or a selectably downward airflow for cooling;

(c) at least one housing for enclosing said at least one component;

(d) at least one heating element disposed exterior and upward of said motor;

(e) at least one secondary fan blade disposed exterior and upward of said motor and responsive to rotation of said at least one motor for urging a second airflow past said at least one heating element to heat the second airflow when said room conditioner is operating in the heating mode; and (f) at least one cover for enclosing at least one component recited in paragraph (a)–(e), said cover including means for discharging the heated second airflow into the first upward airflow when said room conditioner is operated in the heating mode.

15. The room conditioner as set forth in claim 14 wherein said cover is located externally of said at least one motor.

16. The room conditioner as set forth in claim 14 wherein said at least one secondary fan blade is disposed adjacent to and external of said at least one of said heating elements.

17. The room conditioner as set forth in claim 16 wherein said at least one secondary fan blade is disposed interior of said at least one of said heating elements.

18. The room conditioner as set forth in claim 14 including at least one housing for enclosing said at least one motor.

19. The room conditioner as set forth in claim 18 wherein said discharging means includes at least one inlet and at least one outlet for flow of the second airflow into and out of said cover in response to said at least one secondary fan blade.

20. The room conditioner as set forth in claim 18 including at least one inlet and at least one outlet for accommodating flow of air through said at least one housing.

21. The room conditioner as set forth in claim 14 wherein at least one of said heating elements is downstream of the first upward airflow from said at least one blade to minimize heating of said motor by the second airflow.

22. The room conditioner as set forth in claim 14 including means for interconnecting said at least one motor and said at least one secondary fan blade.

23. The room conditioner as set forth in claim 14 wherein said interconnecting means is adapted to said at least one motor.

24. A room conditioner for heating a room, said room conditioner comprising in combination:

(a) an air distribution device having at least one motor and at least one blade for creating a first upward airflow;

(b) at least one support, for supporting said air distribution device;

(c) at least one heating element displaced upward from said air distribution device; and (d) at least one secondary fan blade displaced upward from said air distribution device for conveying a second airflow from at least one of said heating elements into the first upward airflow to mix and heat the first upward airflow.

25. The room conditioner as set forth in claim 24 wherein said at least one secondary fan blade is mounted generally upwards of said air distribution device.

26. The room conditioner as set forth in claim 55 wherein said motor includes a means for interconnecting with said at least one secondary fan blade to rotate said at least one secondary fan blade.

27. The room conditioner as set forth in claim 26 including a casing for enclosing said motor, said interconnecting means being adapted said casing and to said at least one secondary fan blade.

28. The room conditioner as set forth in claim 27 wherein said room conditioner includes at least one housing for enclosing said casing and at least one cover for enclosing at least one of said at least one heating elements and said at least one secondary fan blade.

29. The room conditioner as set forth in claim 28 wherein said at least one housing includes at least one inlet and at least one outlet for accommodating airflow into and out of said at least one housing in response to the first upward airflow from said air distribution device.

30. The room conditioner as set forth in claim 25 wherein at least one of said heating elements and said at least one secondary fan blade comprise a heating unit.

31. The room conditioner as set forth in claim 30 wherein said at least one secondary fan blade is comprised of more than one fan blade.

32. The room conditioner as set forth in claim 30 wherein said at least one secondary fan blade is disposed upward of said at least one motor.

33. The room conditioner as set forth in claim 30 wherein said at least one secondary fan blade is at the upstream end of at least one of said at least one heating elements to induce a flow of air through at least one outlet.

34. A method for heating a room with a room conditioner, said method comprising the steps of:

(a) producing a upward first airflow with an air distribution device having at least one blade, which air distribution device is supported from at least one support;

(b) generating a second airflow with at least one secondary fan blade displaced upward along at least one support from the air distribution device for mixing with the first upward airflow; and (c) heating the second airflow with at least one heating element displaced upward and isolated from the air distribution device prior to mixing the second airflow with the first upward airflow to elevate the temperature of the first upward airflow.

35. The method as set forth in claim 34 wherein said step of producing is performed in response to rotation of the at least one blade of the air distribution device.

36. The method as set forth in claim 34 wherein the air distribution device includes at least one motor supporting the at least one blade and wherein said step of generating is carried out by means for interconnecting the casing with the at least one secondary fan blade.

37. A room conditioner for heating a room, said room conditioner comprising in combination:

(a) at least one support dependingly supported from an upward location;

(b) a motor rotatably adapted to at least one of said supports;

(c) at least one fan blade extending from said motor for generating a first upward airflow;

(d) at least one heating element for heating air flowing therepast, at least one of said heating element being located upward of said motor;

(e) at least one secondary fan blade rotationally responsive to rotation of said motor for urging a flow of air past at least one of said heating element to produce a heated second airflow for mixing with the first upward airflow generated by at least one of said at least one fan blades upon energization of said motor; and (f) a heat sink barrier for reducing transfer of heat between at least one of said heating element and said motor.

* * * * *